US005167844A

United States Patent [19]

Schumacher et al.

[11] Patent Number: 5,167,844

[45] Date of Patent: Dec. 1, 1992

[54] LUBRICANT FORMULATIONS

[75] Inventors: Rolf Schumacher, Marly, Switzerland; Horst Zinke, Reichelsheim/Odw., Fed. Rep. of Germany

[73] Assignee: Ciba-Geigy Corporation, Ardsley, N.Y.

[21] Appl. No.: 606,401

[22] Filed: Oct. 31, 1990

[30] Foreign Application Priority Data

Nov. 8, 1989 [CH] Switzerland ..... 4018/89

[51] Int. Cl.[5] ..... C10M 135/36

[52] U.S. Cl. ..... 252/32.7 R; 252/32.5; 252/46.6

[58] Field of Search ..... 252/32.7 R, 32.5, 46.6

[56] References Cited

U.S. PATENT DOCUMENTS

| | | | |
|---|---|---|---|
| 2,758,086 | 8/1956 | Stuart | 252/32.5 |
| 3,412,118 | 11/1968 | Kujawa et al. | 252/32.5 |
| 3,791,985 | 2/1974 | Eiseman | 252/32.7 R |
| 3,951,829 | 4/1976 | Mullen et al. | 252/32.5 |
| 4,085,132 | 4/1978 | Park et al. . | |
| 4,889,883 | 12/1989 | Rosenberg et al. . | |
| 4,917,809 | 4/1990 | Zinke et al. . | |

FOREIGN PATENT DOCUMENTS

| | | |
|---|---|---|
| 0239536 | 3/1987 | European Pat. Off. . |
| 0346283 | 12/1989 | European Pat. Off. . |
| 0356677 | 3/1990 | European Pat. Off. . |
| 1594405 | 3/1974 | Fed. Rep. of Germany . |

OTHER PUBLICATIONS

Auto, Motor, Sport 13/89.

*Primary Examiner*—Brian E. Hearn
*Assistant Examiner*—Maria Nuzzolillo
*Attorney, Agent, or Firm*—Luther A. R. Hall

[57] ABSTRACT

Formulation containing A) a lubricant and a mixture of B) for example, at least one of the compounds O,O-bis-2-ethylhexylsodium dithiophosphate, O,O-bis-2-ethylhexylsodium thionophosphate, O,O-bis-2-methylpropylsodium dithiophosphate, O,O-bis-nonylphenylsodium dithiophosphate or S-[O,O-bis-2-ethylhexylthiophosphoryl]-potassium thioglycolate, C) at least one compound from the series of the aromatic amines, for example the diphenylamines or phenothiazines, and D) at least one compound from the series of the cyclic sterically hindered amines, the acyclic sterically hindered amines and the phenols of the formula wherein $R^4$, $R^5$ and A are, for example, alkyl radicals.

Such lubricant formulations have a high degree of stability towards oxidative degradation.

19 Claims, No Drawings

LUBRICANT FORMULATIONS

The invention relates to lubricant formulations that are stabilised against oxidative degradation. The stabilisation is effected by the addition of at least three specific additives to the lubricant.

It is known to add additives to lubricants, such as mineral oils or synthetic and semi-synthetic oils, in order to improve properties in use.

Great importance is attached to additives that inhibit the oxidative degradation of the lubricants and ensure a high degree of storage stability and consistency of action.

In particular, the thermo-oxidative requirement profile of modern motor oils has changed as a result of new engine designs in the field of internal combustion engines having self-ignition or spark ignition. In engines having spark ignition, for example, present-day engine layouts and operating methods result in the increased formation of nitrogen oxides which, in turn, pass into the crankcase as "blow-by" gases.

In addition, the lubricating oil in the upper piston ring and cylinder region provides the fine sealing with respect to the combustion chamber. Here contamination with high boiling fuel components can occur. These given conditions are aggravated by the presence of $NO_x$.

The blow-by gases, which contain increasingly high proportions of $NO_x$, then result in the lubricating oil's having a greater susceptibility to oxidation, and "sludge nuclei" are formed which finally result in undesirable sludge deposits which have become known as "black sludge".

It is to be assumed that $NO_x$-initiated auto-oxidation of the lubricating oil is involved.

There has been no lack of attempts to improve lubricating oils by the addition of anti-oxidants.

An additional difficulty lies in the fact that attempts are being made at least partly to eliminate heavy metals from the lubricant additives on ecological and technical grounds. In particular, efforts are being made today at least partly to replace the highly effective additive zinc dialkyl dithiophosphate, which is found in many lubricants, in order to reduce the heavy metal content in the lubricant. The reduced heavy metal content in the lubricant has a positive effect on the service life of the exhaust catalysts now being mounted in the exhaust gas flow of petroleum engines (Auto, Motor und Sport, Vol. 13, June 16, 1989, pages 70–72).

For example, in engines with self-ignition, such as diesel engines, as a result of the smaller amounts of oil in the lubrication system and the higher operating temperatures, as are demanded today, the lubricating oil is subjected to greater frictional stress at a higher operating temperature. Under such conditions known lubricating oils have an increased tendency towards an undesirable thickening and increase in viscosity.

Mineral lubricating oil mixtures and especially steam turbine oils having improved stability are disclosed, for example, in DE-AS 1 594 405. Steam turbine oils are described that contain an aliphatic carboxylic acid having at least 12 carbon atoms, an alkylphenol, an aromatic amine and a dialkyl dithiophosphate. Alkali metal salts of dialkyl thiophosphates are mentioned, but only the zinc dialkyl dithiophosphates are preferred and used in the practical examples.

EP-A-239 536 discloses lubricant formulations that contain in a mineral lubricating oil a phenolic and/or an aminic anti-oxidant in addition to a metal deactivator of the azole type and a hydroxyalkylalkanolamine corrosion inhibitor.

It has now been found that a mixture of at least three additives allows the use of alkali metal dialkyl dithiophosphates in lubricants, the anti-oxidant action surprisingly being improved while, at the same time, such lubricant formulations exhibit a remarkably good performance. The formulations according to the invention are able in particular to prevent or reduce the thickening of the oil that occurs under frictional stress at relatively high temperature.

The subject of the invention is a formulation containing

A) a lubricant and a mixture of

B) at least one compound of general formula I

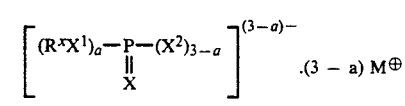

(I)

wherein X, $X^1$ and $X^2$, each independently of the others, are oxygen or sulfur; or $X^2$ is

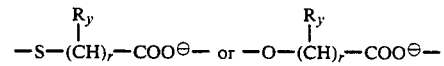

in which r is 1 or 2 and Ry is —H or —$CH_3$; wherein $R^x$ is $C_1$–$C_{24}$alkyl or is $C_2$–$C_{12}$alkyl that is interrupted by —O—, —S— and/or —C(O)O—; unsubstituted or $C_1$–$C_{12}$alkyl-substituted phenyl; $C_5$–$C_{12}$cycloalkyl or $C_5$–$C_{12}$cycloalkyl that is substituted by $C_1$–$C_4$alkyl; or $C_7$–$C_{13}$aralkyl or $C_7$–$C_{13}$aralkyl that is interrupted in the alkyl radical by —O— or —S—; a is 1 or 2, and in the case where a is 2, the radicals $R^x$ are identical or different or two radicals $R^x$, together with the two hetero atoms $X^1$ and the P atom to which they are bonded, form a 5- or 6-membered ring by means of a dimethylene or trimethylene group or by means of a dimethylene or trimethylene group that is substituted by at least one $C_1$–$C_4$alkyl group; and wherein $M^{\oplus}$ is an alkali metal cation, with the proviso that when a is 1, two different $M^{\oplus}$ are possible, C) at least one compound from the series of the aromatic amines of formulae II and III

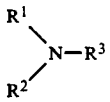

(II)

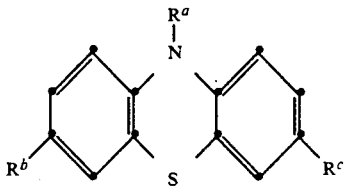

(III)

wherein $R^1$ is $C_1$–$C_{18}$alkyl, $C_7$–$C_9$phenylalkyl, $C_5$–$C_{12}$cycloalkyl, phenyl, $C_7$–$C_{18}$alkylphenyl, $C_7$–$C_{18}$alkoxyphenyl or naphthyl, $R^2$ is phenyl, $C_7$–$C_{18}$alkylphenyl, $C_7$–$C_{18}$alkoxyphenyl or naphthyl, $R^3$ is hydrogen, $C_1$–$C_{12}$alkyl, benzyl, allyl, methallyl, phenyl or a group $—CH_2SR^g$ wherein $R^g$ is —H, alkyl having from 1 to 8 carbon atoms, phenyl or cycloalkyl having from 5 to 12 carbon atoms, $R^a$ is H, $C_1$–$C_{18}$alkyl, $—CH_2COO(C_4$–$C_{18}$alkyl) or $—CH_2CH_2COO(C_4$–$C_{18}$alkyl), and $R^b$ and $R^c$, each independently of the other, are —H, $C_1$–$C_{18}$alkyl or $C_7$–$C_9$phenylalkyl, and D) at least one compound from the series of the cyclic sterically hindered amines, the acyclic sterically hindered amines and the phenols of general formula V

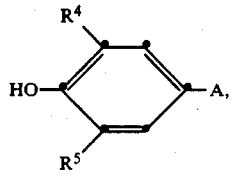

(V)

wherein $R^4$ is H, alkyl having from 1 to 24 carbon atoms, cycloalkyl having from 5 to 12 carbon atoms, $C_1$–$C_4$alkyl-substituted cycloalkyl having from 5 to 12 carbon atoms, phenyl or $—CH_2—S—R^{10}$, $R^5$ is alkyl having from 1 to 24 carbon atoms, cycloalkyl having from 5 to 12 carbon atoms, $C_1$–$C_4$alkyl-substituted cycloalkyl having from 5 to 12 carbon atoms, phenyl or $—CH_2—S—R^{10}$, and A is —H, alkyl having from 1 to 24 carbon atoms, $—C_qH_{2q}—N(R')(R'')$, $—C_qH_{2q}—S_z—Y$, $$—S—CH_2—\underset{\underset{O}{\|}}{C}—OR^7 \text{ or } —C_dH_{2d}—\underset{\underset{O}{\|}}{C}—OR^7,$$

and

Y is —H, alkyl having from 1 to 18 carbon atoms, phenyl, $C_1$–$C_{24}$alkyl-substituted phenyl, benzyl, $$—(CH_2)_f—\underset{\underset{O}{\|}}{C}—OR^6$$

or, when q is 0,

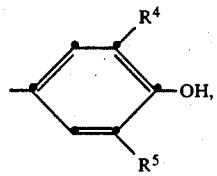

wherein $R^4$ and $R^5$ are each as defined above,

R' and R'' are identical or different and are —H or $C_1$–$C_{24}$alkyl, and f is 1 or 2, d is 0, 1, 2 or 3, q is 0, 1, 2 or 3, z is 1, 2, 3 or 4, $R^6$ is $C_1$–$C_{24}$alkyl, $R^7$ is alkyl having from 1 to 24 carbon atoms,

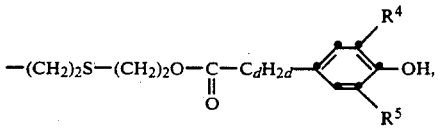

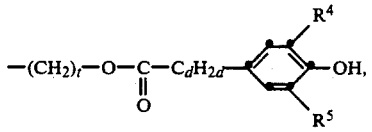

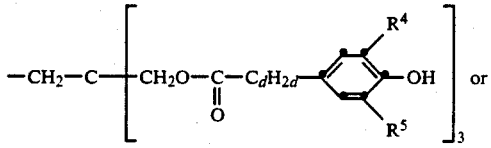

or

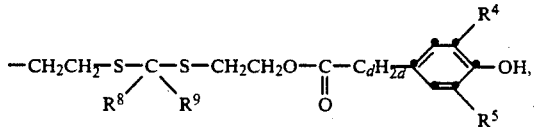

wherein d is in each case 0, 1, 2 or 3 and t is 2, 3, 4, 5 or 6, and wherein $R^4$ and $R^5$ are each as defined above, and $R^8$ and $R^9$, each independently of the other, are H, alkyl having from 1 to 12 carbon atoms, phenyl or phenyl substituted by one or two $C_1$–$C_4$alkyl groups and/or —OH, or $R^8$ and $R^9$ together with the carbon atom linking them form a $C_5$–$C_{12}$cycloalkyl group, and $R^{10}$ is $C_1$–$C_{18}$alkyl, phenyl or $$—(CH_2)_f—\underset{\underset{O}{\|}}{C}—OR^6$$

wherein f and $R^6$ are as defined above.

Accordingly, the formulation according to the invention is a lubricant that contains at least one ternary mixture as anti-oxidant additive.

The definitions of $R^x$, $M^{\oplus}$, X, $X^1$, $X^2$, a and b in compounds of general formula I have, for example, the following meanings.

When $R^x$ is $C_1$–$C_{24}$alkyl, it includes straight-chain or branched alkyl radicals, for example methyl, ethyl, n-propyl, isopropyl, n-butyl, isobutyl, sec.-butyl, tert.-butyl, 2-methylpropyl, pentyl, hexyl, heptyl, octyl, 2-ethylhexyl, nonyl, decyl, undecyl, dodecyl, tetradecyl, hexadecyl, heptadecyl, octadecyl or eicosyl. Radicals containing from 3 to 12 carbon atoms are preferred, and radicals containing from 3 to 8 carbon atoms are especially preferred.

When $R^x$ is $C_2$–$C_{12}$alkyl interrupted by —O—, —S— or —C(O)O—, the hetero atom or the —C(O)O— group can be in any of the possible positions, and the $C_2$–$C_{12}$alkyl radical can be interrupted one or more times by identical or different hetero atoms as well as by —C(O)O— groups. One interruption is preferred.

When $R^x$ is $C_1$–$C_{12}$alkyl-substituted phenyl, the phenyl radical can be mono- or poly-substituted, but preferably mono- or di-substituted; $C_1$–$C_{12}$alkyl is, for example, methyl, ethyl, n-propyl, isopropyl, n-butyl, isobutyl, sec.-butyl, tert.-butyl, straight-chain or branched nonyl or dodecyl. Monosubstituted phenyl is preferred, the alkyl radical advantageously containing from 3 to 12 carbon atoms and preferably from 8 to 12 carbon atoms. Nonylphenyl is especially advantageous.

When $R^x$ is $C_5$–$C_{12}$cycloalkyl, it includes, for example, cyclopentyl, cyclohexyl, cycloheptyl, cyclooctyl, cyclononyl, cyclodecyl, cycloundecyl and cyclododecyl, preferably cyclohexyl.

When $R^x$ is $C_1$–$C_4$alkyl-substituted $C_5$–$C_{12}$cycloalkyl, it may be mono- or poly-substituted, but is preferably monosubstituted, and may be, for example, methylcyclohexyl, trimethylcyclohexyl, butylcyclohexyl or propylcyclopentyl.

When $R^x$ is $C_7$–$C_{13}$aralkyl, it includes, for example, benzyl, 1- or 2-phenethyl, 3-phenylpropyl, α,α-dimethylbenzyl, 2-phenylisopropyl, 2-phenylhexyl, benzhydryl and naphthylmethyl, but preferably benzyl.

When $R^x$ is $C_7$–$C_{13}$aralkyl interrupted in the alkyl radical by —O— or —S—, a typical example thereof is a phenoxyethyl group.

When two radicals $R^x$, together with the two hetero atoms $X^1$ and the P atom to which they are bonded, form a 5- or 6-membered ring by means of a dimethylene or trimethylene group that is substituted by at least one $C_1$–$C_4$alkyl group, then the dimethylene or trimethylene group advantageously carries one, two or three alkyl groups having 1, 2, 3 or 4 carbon atoms and preferably one or two alkyl groups having 1, 2 or 4 carbon atoms.

$M^{\oplus}$ is an alkali metal cation, for example $Li^{\oplus}$, $Na^{\oplus}$, $K^{\oplus}$ or $Rb^{\oplus}$. Preferred metal cations $M^{\oplus}$ are $Na^{\oplus}$ and $K^{\oplus}$.

An advantageous embodiment comprises formulations wherein in the compounds of formula I $R^x$ is $C_1$–$C_{12}$alkyl optionally interrupted by —O—, —S— or —C(O)O—, or unsubstituted or $C_1$–$C_{12}$alkyl-substituted, especially $C_8$–$C_{12}$alkyl-substituted, phenyl; cyclohexyl or benzyl, $R^x$ preferably being $C_3$–$C_{12}$alkyl optionally interrupted by —C(O)O—, or phenyl or nonylphenyl.

Also of interest are formulations wherein in the compounds of formula I X is oxygen, and also those wherein in the compounds of formula I $X^1$ and $X^2$ are oxygen, or those wherein in the compounds of formula I X and $X^2$ are sulfur and $X^1$ is oxygen.

Formulations wherein in the compounds of formula I $M^{\oplus}$ $Na^{\oplus}$ are of further interest.

Formulations wherein in the compounds of formula I X is sulfur, and also those wherein in the compounds of formula I X is sulfur and $X^1$ and $X^2$ are oxygen; or those wherein in the compounds of formula I X is sulfur, $X^1$ is oxygen and $X^2$ is sulfur, are of additional interest.

Formulations wherein in the compounds of formula I X is sulfur, $X^1$ is oxygen, $X^2$ is sulfur or oxygen, $R^x$ is $C_3$–$C_8$alkyl or $C_8$–$C_{12}$alkyl-substituted phenyl, a is 2, b is 1 and $M^{\oplus}$ is $Na^{\oplus}$ or $K^{\oplus}$, are of particular interest. M can be especially sodium.

When $X^2$ is, for example, $$-S-\overset{\overset{R_y}{|}}{(CH)_r}-COO^{\ominus}- \text{ or } -O-\overset{\overset{R_y}{|}}{(CH)_r}-COO^{\ominus}-.$$

then $R^y$ is —H or $-CH_3$ and r is 1 or 2. Especially preferred groups are, for example, $-S-CH_2-COO^{\oplus}-$, $-O-CH_2-COO^{\oplus}-$, $-S-CH_2-CH_2-COO^{\oplus}-$, $-O-CH_2-CH_2-COO^{\oplus}-$, $$-S-\overset{\overset{CH_3}{|}}{CH}-\overset{\overset{CH_3}{|}}{CH}-COO^{\ominus}-,\ -O-\overset{\overset{CH_3}{|}}{CH}-\overset{\overset{CH_3}{|}}{CH}-COO^{\ominus}-,$$

$$-S-CH_2-\overset{\overset{CH_3}{|}}{CH}-COO^{\ominus}- \text{ and } -O-CH_2-\overset{\overset{CH_3}{|}}{CH}-OO^{\ominus}-.$$

The following compounds are of very special interest: O,O-bis-nonylphenylsodium dithiophosphate, O,O-bis-nonylphenylsodium thionophosphate, O,O-bis-2-ethylhexylsodium dithiophosphate, O,O-dibutylsodium dithiophosphate, O,O-dicyclohexylsodium dithiophosphate, O,O-di-n-octylpotassium thionophosphate, O,O-di-isononyllithium dithiophosphate, O,O-diethylsodium dithiophosphate, O,O-bis-dodecylphenylsodium dithiophosphate, O,O-dipentylsodium dithiophosphate, O,O-bis-2-ethylhexylsodium thionophosphate, O,O-dipropylpotassium dithiophosphate, O,O-bis-2-methylpropylsodium dithiophosphate, O,O-di-isodecylpotassium thionophosphate, S-[O,O-di-n-dodecylphosphoryl]-potassium thioglycolate, 2-potassiummercapto-2-thiono-5,5-dimethyl-[1,3,2]-dioxaphosphorinane, 2-sodiummercapto-2-oxo-5-butyl-5-ethyl-[1,3,2]-dioxaphosphorinane, O,O-dibenzylpotassium dithiophosphate, S-[2-thiono-5,5-dimethyl-[1,3,2]-dioxaphosphorinanyl]-β-mercaptolithium propionate, O,O-bis-1-methylethylsodium dithiophosphate, O-ethyl-O-1-methylpropylsodium dithiophosphate, O,O-bis-2-phenoxyethylsodium dithiophosphate, O,O-bis-dodecylphenylsodium thionophosphate, O,O-bis-1-methylpropylsodium dithiophosphate, O,O-bis-2-butoxyethyllithium dithiophosphate, O-tridecyl-O-pentadecylpotassium dithiophosphate, O,O-bis-isopropylphenylsodium dithiophosphate, O,O-bis-2-butylthioethylsodium dithiophosphate, S-[O,O-bis-2-ethylhexylthiophosphoryl]-sodium thioglycolate, S-[O,O-bis-2-ethylhexylphosphoryl]-potassium thioglycolate, S-[O,O-diisopropylthiophosphoryl]-β-mercaptolithium propionate, S-[O,O-dipentylthiophosphoryl]-3-mercapto-2-methyllithium propionate, O,O-bis-2-decyltetradecylpotassium dithiophosphate.

The meanings of the substituents in compounds of formulae II and III, and advantageous and preferred compounds of formulae II and III, are given by way of example below.

$R^3$ as $C_1$–$C_{12}$alkyl can be linear or branched alkyl and can be, for example, methyl, ethyl, propyl, n-butyl, tert.-butyl, pentyl, hexyl, octyl, 2-ethylhexyl, nonyl, decyl or dodecyl. $R^1$, $R^a$, $R^b$ and $R^c$ as $C_1$–$C_{18}$alkyl can also be, for example, tetradecyl, pentadecyl, hexadecyl or octadecyl. $R^a$ can advantageously be $C_4$–$C_{18}$alkyl, for example n-butyl, tert.-butyl, n-hexyl, 2-ethylhexyl, nonyl, n-dodecyl or octadecyl.

$R^1$, $R^b$ and $R^c$ as $C_7$–$C_9$phenylakyl can be, for example, benzyl, 2-phenylethyl, α-methylbenzyl, 2-phenylpropyl or α,α-dimethylbenzyl.

$R^1$ and $R^g$ as cycloalkyl having from 5 to 12 carbon atoms are, for example, cyclopentyl, cyclohexyl, cycloheptyl, cyclooctyl, cyclononyl, cyclodecyl, cycloundecyl and cyclododecyl. Cyclohexyl is preferred. $R^1$ and $R^2$ as $C_7$–$C_{18}$alkylphenyl can be mono- or polysubstituted phenyl having linear or branched alkyl groups. Phenyl radicals substituted by one or two alkyl groups are advantageous. Examples are tolyl, ethylphenyl, isopropylphenyl, tert.-butylphenyl, sec.-pentylphenyl, n-hexylphenyl, tert.-octylphenyl, isononylphenyl and n-dodecylphenyl. $R^1$ and $R^2$ may also be mixtures of alkylphenyl groups, as are formed in industrial alkylations of diphenylamine by means of olefins. The alkyl group is preferably in the para-position of the aromatic amine.

When $R^1$ and $R^2$ are $C_7$–$C_{18}$alkoxyphenyl, examples thereof are methoxyphenyl and ethoxyphenyl.

It is preferable to use as component C) a compound of formula II or III wherein $R^1$ is $C_1$–$C_4$alkyl, $C_7$–$C_9$phenylalkyl, cyclohexyl, phenyl, $C_{10}$–$C_{18}$alkylphenyl or naphthyl, $R^2$ is $C_{10}$–$C_{18}$alkylphenyl or phenyl, $R^3$ is hydrogen, $C_1$–$C_8$alkyl, benzyl, allyl or a group $—CH_2SR^g$ wherein $R^g$ is —H, $C_1$–$C_4$alkyl, phenyl or cyclohexyl, $R^a$ is H, $C_1$–$C_{18}$alkyl or $—CH_2COO(C_8$–$C_{18}$alkyl), and $R^b$ and $R^c$, each independently of the other, are H, $C_1$–$C_{12}$alkyl or $C_7$–$C_9$phenylalkyl.

Further compounds of formula III are those wherein $R^a$ is advantageously $C_4$–$C_{18}$alkyl or $—CH_2COO(C_8$–$C_{18}$alkyl).

Especially preferred compounds of formula II are those wherein $R^1$ and $R^2$, each independently of the other, are phenyl or $C_{10}$–$C_{18}$alkylphenyl, especially mono- or di-tert.-butylphenyl or tert.-octylphenyl, and $R^3$ is hydrogen.

Especially preferred compounds of formula III are those wherein $R^a$ is hydrogen and $R^b$ and $R^c$, each independently of the other, are H or $C_4$–$C_{12}$-alkyl. Examples of compounds of formulae II and III are:

diphenylamine,
N-allyldiphenylamine,
4-isopropoxydiphenylamine,
N-phenyl-1-naphthylamine,
N-phenyl-2-naphthylamine,
di-4-methoxyphenylamine,
di-[4-(1,3-dimethylbutyl)-phenyl]-amine,
di-[4-(1,1,3,3-tetramethylbutyl)-phenyl]-amine,
tert.-octylated N-phenyl-1-naphthylamine,
industrial mixtures obtained by alkylation of diphenylamine with alkenes, especially with octenes, for example with diisobutylene (for example mono-, di- and tri-alkylated tert.-butyl- and tert.-octyl-diphenylamines),
phenothiazine,
N-allylphenothiazine,
3,7-di-tert.-octylphenothiazine,
industrial mixtures obtained by alkylation of phenothiazine with alkenes, especially with octenes, for example with diisobutylene.

Especially preferred is the use as component C) of 4,4'-di-tert.-octyldiphenylamine or 3,7-di-tert.-octylphenothiazine or an industrial mixture obtained by reaction of diphenylamine with diisobutylene, especially such a mixture containing the following constituents:

| | |
|---|---|
| 1 to 5% by weight | a) diphenylamine, |
| 8 to 18% by weight | b) 4-tert.-butyldiphenylamine, |
| 21 to 31% by weight | c) one or more of the compounds<br>i) 4-tert.-octyldiphenylamine,<br>ii) 4,4'-di-tert.-butyldiphenylamine,<br>iii) 2,4,4'-tris-tert.-butyldiphenylamine, |
| 20 to 31% by weight | d) one or more of the compounds<br>i) 4-tert.-butyl-4'-tert.-octyldiphenylamine,<br>ii) 2,2'-or 2,4'-di-tert.-octyldiphenylamine,<br>iii) 2,4-di-tert.-butyl-4'-tert.-octyldiphenylamine and |
| 15 to 29% by weight | e) the compound<br>i) 4,4'-di-tert.-octyldiphenylamine or the compounds<br>i) 4,4'-di-tert.-octyldiphenylamine and<br>ii) 2,4-di-tert.-octyl-4'-tert.-butyldiphenylamine. |

An especially preferred diphenylamine mixture contains as component C) 3.2% diphenylamine, 13.2% mono-tert.-butyldiphenylamines, 25.3% mono-tert.-octyldiphenylamines and di-tert.-butyldiphenylamines, 24.2% tert.-butyl-tert.-octyldiphenylamines, 24.3% di-tert.-octyldiphenylamines and other higher alkylated diphenylamines, the content of 4,4'-di-tert.-octyldiphenylamine being 18.2%, and further relatively small amounts of diphenylamines having partially modified side chains and polymers to make up to 100%.

Examples of further components C) containing compounds of formulae II and III are:

N-substituted diphenylamines of the general formula

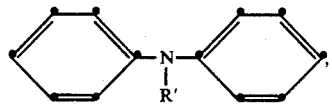

wherein R' is methyl, ethyl, propyl or allyl;

a diphenylamine compound of the formula

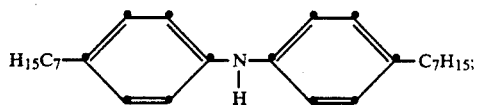

a diphenylamine compound of the formula

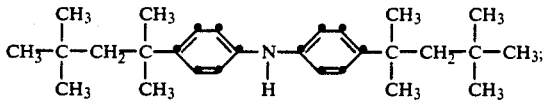

a diphenylamine compound of the formula

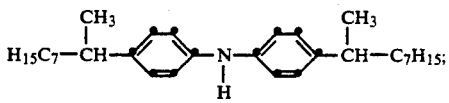

a mixture containing diphenylamine compounds of the formulae

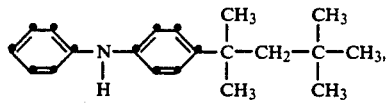

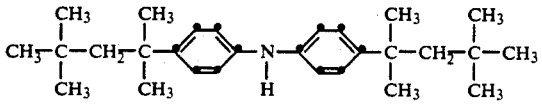

and

-continued

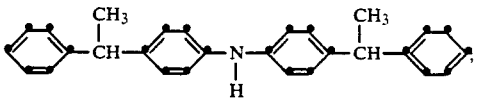

a mixture containing diphenylamine compounds of the formulae

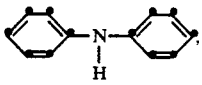

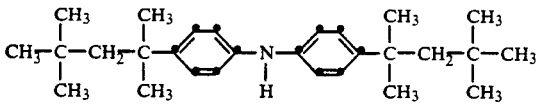

and

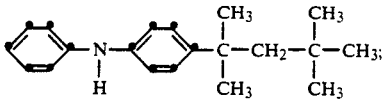

a diphenylamine compound of the formula

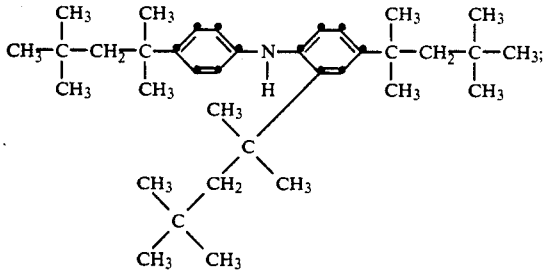

Component D) can be any cyclic or acyclic sterically hindered amine. D) is preferably a cyclic sterically hindered amine, especially a compound containing at least one group of formula (VI)

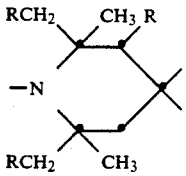

(VI)

wherein R is hydrogen or methyl. R is preferably hydrogen. These are derivatives of polyalkylpiperidines, especially of 2,2,6,6-tetramethylpiperidine. These polyalkylpiperidines preferably carry in the 4-position one or two polar substituents or a polar spiro-ring system.

The following classes of polyalkylpiperidines are of particular importance.

a) Compounds of formula VII

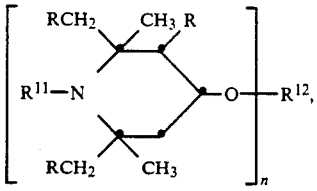

(VII)

wherein n is from 1 to 4, preferably 1 or 2, R is hydrogen or methyl, $R^{11}$ is hydrogen, oxyl, hydroxy, $C_1$–$C_{12}$alkyl, $C_3$–$C_8$alkenyl, $C_3$–$C_8$alkynyl, $C_7$–$C_{12}$aralkyl, $C_1$–$C_{18}$alkoxy, $C_5$–$C_8$cycloalkoxy, $C_7$–$C_9$phenylalkoxy, $C_1$–$C_8$alkanoyl, $C_3$–$C_5$alkenoyl, $C_1$–$C_{18}$-alkanoyloxy, benzyloxy, glycidyl or a group —$CH_2CH(OH)$—Z wherein Z is hydrogen, methyl or phenyl, $R^{11}$ preferably being H, $C_1$–$C_4$alkyl, allyl, benzyl, acetyl or acryloyl, and when n is 1, $R^{12}$ is hydrogen, $C_1$–$C_{18}$alkyl optionally interrupted by one or more oxygen atoms, cyanoethyl, benzyl, glycidyl, a monovalent radical of an aliphatic, cycloaliphatic, araliphatic, unsaturated or aromatic carboxylic acid, carbamic acid or phosphorus-containing acid, or is a monovalent silyl radical, preferably a radical of an aliphatic carboxylic acid having from 2 to 18 carbon atoms, a cycloaliphatic carboxylic acid having from 7 to 15 carbon atoms, an $\alpha,\beta$-unsaturated carboxylic acid having from 3 to 5 carbon atoms or an aromatic carboxylic acid having from 7 to 15 carbon atoms, and when n is 2, $R^{12}$ is $C_1$–$C_{12}$-alkylene, $C_4$–$C_{12}$alkenylene, xylylene, a divalent radical of an aliphatic, cycloaliphatic, araliphatic or aromatic dicarboxylic acid, dicarbamic acid or phosphorus-containing acid, or is a divalent silyl radical, preferably a radical of an aliphatic dicarboxylic acid having from 2 to 36 carbon atoms, a cycloaliphatic or aromatic dicarboxylic acid having from 8 to 14 carbon atoms or an aliphatic, cycloaliphatic or aromatic dicarbamic acid having from 8 to 14 carbon atoms, and when n is 3, $R^{12}$ is a trivalent radical of an aliphatic, cycloaliphatic or aromatic tricarboxylic acid, and aromatic tricarbamic acid or a phosphorus-containing acid, or is a trivalent silyl radical, and when n is 4, $R^{12}$ is a tetravalent radical of an aliphatic, cycloaliphatic or aromatic tetracarboxylic acid.

When any substituents are $C_1$–$C_{12}$alkyl, they are, for example, methyl, ethyl, n-propyl, n-butyl, sec.-butyl, tert.-butyl, n-hexyl, n-octyl, 2-ethylhexyl, n-nonyl, n-decyl, n-undecyl or n-dodecyl.

$R^{11}$ or $R^{12}$ as $C_1$–$C_{18}$alkyl may be, for example, the groups listed above and in addition, for example, n-tridecyl, n-tetradecyl, n-hexadecyl or n-octadecyl.

When $R^{11}$ is $C_3$–$C_8$alkenyl, it may include, for example, 1-propenyl, allyl, methallyl, 2-butenyl, 2-pentenyl, 2-hexenyl, 2-octenyl and 4-tert.-butyl-2-butenyl.

$R^{11}$ as $C_3$–$C_8$alkynyl is preferably propargyl.

$R^{11}$ as $C_7$–$C_{12}$aralkyl is especially phenethyl and more especially benzyl.

$R^{11}$ as $C_1$–$C_8$alkanoyl is, for example, formyl, propionyl, butyryl, octanoyl, but preferably acetyl, and as $C_3$–$C_5$alkenoyl especially acryloyl.

When $R^{12}$ is a monovalent radical of a carboxylic acid, it is, for example, an acetic acid, caproic acid, stearic acid, acrylic acid, methacrylic acid, benzoic acid or $\beta$-(3,5-di-tert.-butyl-4-hydroxyphenyl)-propionic acid radical.

When $R^{12}$ is a divalent radical of a dicarboxylic acid, it is, for example, a malonic acid, succinic acid, glutaric acid, adipic acid, suberic acid, sebacic acid, maleic acid, itaconic acid, phthalic acid, dibutylmalonic acid, dibenzylmalonic acid, butyl-(3,5-di-tert.-butyl-4-hydroxybenzyl)-malonic acid or bicycloheptenedicarboxylic acid radical.

When $R^{12}$ is a trivalent radical of a tricarboxylic acid, it is, for example, a trimellitic acid, citric acid or nitrilotriacetic acid radical.

When $R^{12}$ is a tetravalent radical of a tetracarboxylic acid, it is, for example, the tetravalent radical of butane-1,2,3,4-tetracarboxylic acid or of pyromellitic acid.

When $R^{12}$ is a divalent radical of a dicarbamic acid, it is, for example, a hexamethylenedicarbamic acid or a 2,4-toluylenedicarbamic acid radical.

Compounds of formula VII wherein R is hydrogen, $R^{11}$ is hydrogen or methyl, n is 2 and $R^{12}$ is the diacyl radical of an aliphatic dicarboxylic acid having from 4 to 12 carbon atoms are preferred.

The following compounds are examples of polyalkylpiperidine compounds of this class:

1) 4-hydroxy-2,2,6,6-tetramethylpiperidine
2) 1-allyl-4-hydroxy-2,2,6,6-tetramethylpiperidine
3) 1-benzyl-4-hydroxy-2,2,6,6-tetramethylpiperidine
4) 1-(4-tert.-butyl-2-butenyl)-4-hydroxy-2,2,6,6-tetramethylpiperidine
5) 4-stearoyloxy-2,2,6,6-tetramethylpiperidine
6) 1-ethyl-4-salicyloyloxy-2,2,6,6-tetramethylpiperidine
7) 4-methacryloyloxy-1,2,2,6,6-pentamethylpiperidine
8) 1,2,2,6,6-pentamethylpiperidin-4-yl-β-(3,5-di-tert.-butyl-4-hydroxyphenyl)-propionate
9) di-(1-benzyl-2,2,6,6-tetramethylpiperidin-4-yl)-maleinate
10) di-(2,2,6,6-tetramethylpiperidin-4-yl)-succinate
11) di-(2,2,6,6-tetramethylpiperidin-4-yl)-glutarate
12) di-(2,2,6,6-tetramethylpiperidin-4-yl)-adipate
13) di-(2,2,6,6-tetramethylpiperidin-4-yl)-sebacate
14) di-(1,2,2,6,6-pentamethylpiperidin-4-yl)-sebacate
15) di-(1,2,3,6-tetramethyl-2,6-diethylpiperidin-4-yl)-sebacate
16) di-(1-allyl-2,2,6,6-tetramethylpiperidin-4-yl)-phthalate
17) 1-hydroxy-4-β-cyanoethyloxy-2,2,6,6-tetramethylpiperidine
18) 1-acetyl-2,2,6,6-tetramethylpiperidin-4-yl acetate
19) trimellitic acid tri-(2,2,6,6-tetramethylpiperidin-4-yl) ester
20) 1-acryloyl-4-benzyloxy-2,2,6,6-tetramethylpiperidine
21) diethylmalonic acid di-(2,2,6,6-tetramethylpiperidin-4-yl) ester
22) dibutylmalonic acid di-(1,2,2,6,6-pentamethylpiperidin-4-yl) ester
23) butyl-(3,5-di-tert.-butyl-4-hydroxybenzyl)-malonic acid di-(1,2,2,6,6-pentamethylpiperidin-4-yl) ester
24) di-(1-octyloxy-2,2,6,6-tetramethylpiperidin-4-yl)-sebacate
25) di-(1-cyclohexyloxy-2,2,6,6-tetramethylpiperidin-4-yl)-sebacate
26) hexane-1',6'-bis-(4-carbamoyloxy-1-n-butyl-2,2,6,6-tetramethylpiperidine)
27) toluene-2',4'-bis-(4-carbamoyloxy-1-n-propyl-2,2,6,6-tetramethylpiperidine)
28) dimethyl-bis-(2,2,6,6-tetramethylpiperidin-4-oxy)-silane
29) phenyl-tris-(2,2,6,6-tetramethylpiperidine-4-oxy)-silane
30) tris-(1-propyl-2,2,6,6-tetramethylpiperidin-4-yl)-phosphite
31) tris-(1-propyl-2,2,6,6-tetramethylpiperidin-4-yl)-phosphate
32) phenyl-[bis-(1,2,2,6,6-pentamethylpiperidin-4-yl)]-phosphonate
33) 4-hydroxy-1,2,2,6,6-pentamethylpiperidine
34) 4-hydroxy-N-hydroxyethyl-2,2,6,6-tetramethylpiperidine
35) 4-hydroxy-N-(2-hydroxypropyl)-2,2,6,6-tetramethylpiperidine
36) 1-glycidyl-4-hydroxy-2,2,6,6-tetramethylpiperidine.

b) Compounds of formula (VIII)

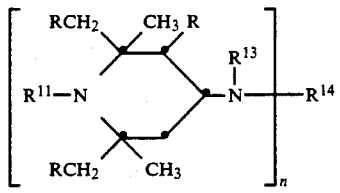

(VIII)

wherein n is 1 or 2, R and $R^{11}$ are as defined under a), $R^{13}$ is hydrogen, $C_1$–$C_{12}$alkyl, $C_2$–$C_5$hydroxyalkyl, $C_5$–$C_7$cycloalkyl, $C_7$–$C_8$aralkyl, $C_2$–$C_{18}$-alkanoyl, $C_3$–$C_5$alkenoyl, benzoyl, or a group of the formula

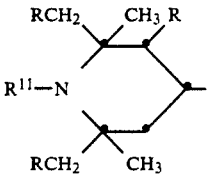

and when n is 1, $R^{14}$ is hydrogen, $C_1$–$C_{18}$alkyl, $C_3$–$C_8$alkenyl, $C_5$–$C_7$cycloalkyl, $C_1$–$C_4$alkyl substituted by a hydroxy, cyano, alkoxycarbonyl or carbamide group, glycidyl, a group of the formula —$CH_2$—CH(OH)—Z or the formula —CONH—Z wherein Z is hydrogen, methyl or phenyl; when n is 2, $R^{14}$ is $C_2$–$C_{12}$alkylene, $C_6$–$C_{12}$arylene, xylylene, a —$CH_2$—CH(OH)—$CH_2$— group or a group —$CH_2$—CH(OH)—$CH_2$—O—D—O— wherein D is $C_2$–$C_{10}$alkylene, $C_6$–$C_{15}$-arylene or $C_6$–$C_{12}$cycloalkylene, or, provided that $R^{13}$ is not alkanoyl, alkenoyl or benzoyl, $R^{14}$ may also be a divalent radical of an aliphatic, cycloaliphatic or aromatic dicarboxylic acid or dicarbamic acid or alternatively may be the group —CO—, or when n is 1, $R^{13}$ and $R^{14}$ together can be the divalent radical of an aliphatic, cycloaliphatic or aromatic 1,2- or 1,3-dicarboxylic acid.

When any substituents are $C_1$–$C_{12}$alkyl or $C_1$–$C_{18}$alkyl, they are as already defined under a).

When any substituents are $C_5$–$C_7$cycloalkyl, they are especially cyclohexyl.

$R^{13}$ as $C_7$–$C_8$aralkyl is especially phenylethyl or more especially benzyl. $R^{13}$ as $C_2$–$C_5$hydroxyalkyl is especially 2-hydroxyethyl or 2-hydroxypropyl.

$R^{13}$ as $C_2$–$C_{18}$alkanoyl is, for example, propionyl, butyryl, octanoyl, dodecanoyl, hexadecanoyl, octadecanoyl, but preferably acetyl, and as $C_3$–$C_5$alkenoyl especially acryloyl.

When $R^{14}$ is $C_2$–$C_8$alkenyl, it is, for example, allyl, methallyl, 2-butenyl, 2-pentenyl, 2-hexenyl or 2-octenyl.

$R^{14}$ as $C_1$–$C_4$alkyl substituted by a hydroxy, cyano, alkoxycarbonyl or carbamide group may be, for example, 2-hydroxyethyl, 2-hydroxypropyl, 2-cyanoethyl, methoxycarbonylmethyl, 2-ethoxycarbonylethyl, 2-aminocarbonylpropyl or 2-(dimethylaminocarbonyl)-ethyl.

When any substituents are $C_2$–$C_{12}$alkylene, they are, for example, ethylene, propylene, 2,2-dimethylpropylene, tetramethylene, hexamethylene, octamethylene, decamethylene or dodecamethylene.

When any substituents are $C_6$–$C_{15}$arylene, they are, for example, o-, m- or p-phenylene, 1,4-naphthylene or 4,4'-diphenylene.

D as $C_6$–$C_{12}$cycloalkylene is especially cyclohexylene.

Preferred compounds of formula VIII are those wherein n is 1 or 2, R is hydrogen, $R^{11}$ is hydrogen or methyl, $R^{13}$ is hydrogen, $C_1$–$C_{12}$alkyl or a group of the formula

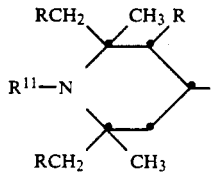

and when n is 1, $R^{14}$ is hydrogen or $C_1$–$C_{12}$alkyl and when n is 2, $R^{14}$ is $C_2$–$C_8$alkylene.

The following compounds are examples of polyalkylpiperidine compounds of this class:

37) N,N'-bis-(2,2,6,6-tetramethylpiperidin-4-yl)-hexamethylene-1,6-diamine, which is regarded as especially preferred, and also
38) N,N'-bis-(2,2,6,6-tetramethylpiperidin-4-yl)-hexamethylene-1,6-diacetamide
39) bis-(2,2,6,6-tetramethylpiperidin-4-yl)-amine
40) 4-benzoylamino-2,2,6,6-tetramethylpiperidine
41) N,N'-bis-(2,2,6,6-tetramethylpiperidin-4-yl)-N,N'-dibutyladipamide
42) N,N'-bis-(2,2,6,6-tetramethylpiperidin-4-yl)-N,N'-dicyclohexyl-2-hydroxypropylene-1,3-diamine
43) N,N'-bis-(2,2,6,6-tetramethylpiperidin-4-yl)-p-xylylenediamine
44) N,N'-bis-(2,2,6,6-tetramethylpiperidin-4-yl)-succindiamide
45) N-(2,2,6,6-tetramethylpiperidin-4-yl)-β-aminodipropionic acid di-(2,2,6,6-tetramethylpiperidin-4-yl) ester
46) the compound of the formula

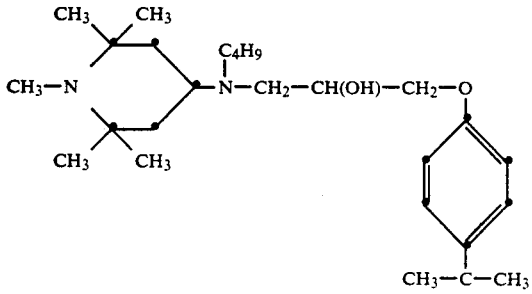

-continued

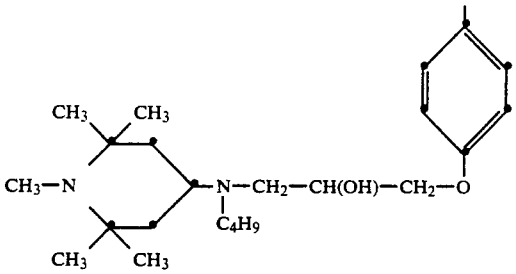

47) 4-(bis-2-hydroxyethylamino)-1,2,2,6,6-pentamethylpiperidine
48) 4-(3-methyl-4-hydroxy-5-tert.-butylbenzamido)-2,2,6,6-tetramethylpiperidine
49) 4-methacrylamido-1,2,2,6,6-pentamethylpiperidine.

c) Compounds of formula (IX)

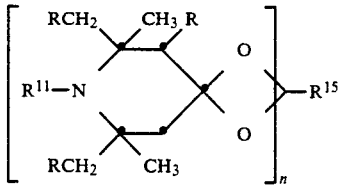

(IX)

wherein n is 1 or 2, R and $R^{11}$ are as defined under a) and when n is 1, $R^{15}$ is $C_2$–$C_8$alkylene, $C_2$–$C_8$hydroxyalkylene or $C_4$–$C_{22}$acyloxyalkylene, and when n is 2, $R^{15}$ is the group $(—CH_2)_2C(CH_2—)_2$.

When $R^{15}$ is $C_2$–$C_8$alkylene or $C_2$–$C_8$hydroxyalkylene, it is, for example, ethylene, 1-methylethylene, propylene, 2-ethylpropylene or 2-ethyl-2-hydroxymethylpropylene.

$R^{15}$ as $C_4$–$C_{22}$acyloxyalkylene is, for example, 2-ethyl-2-acetoxymethylpropylene.

The following compounds are examples of polyalkylpiperidine compounds of this class:

50) 9-aza-8,8,10,10-tetramethyl-1,5-dioxaspiro[5.5]undecane
51) 9-aza-8,8,10,10-tetramethyl-3-ethyl-1,5-dioxaspiro[5.5]undecane
52) 8-aza-2,7,7,8,9,9-hexamethyl-1,4-dioxaspiro[4.5]decane
53) 9-aza-3-hydroxymethyl-3-ethyl-8,8,9,10,10-pentamethyl-1,5-dioxaspiro-[5.5]undecane
54) 9-aza-3-ethyl-3-acetoxymethyl-9-acetyl-8,8,10,10-tetramethyl-1,5-dioxaspiro[5.5]undecane
55) 2,2,6,6-tetramethylpiperidine-4-spiro-2'-(1',3'-dioxane)-5'-spiro-5''-(1'',3''-dioxane)-2''-spiro-4''-(2''',2''',6''',6'''-tetramethylpiperidine).

d) Compounds of formulae XA, XB and XC

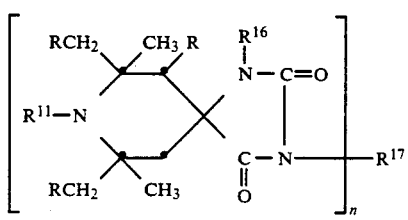

(XA)

-continued

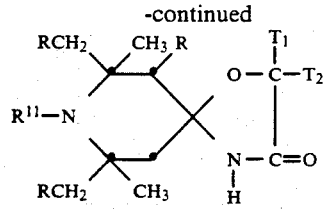

(XB)

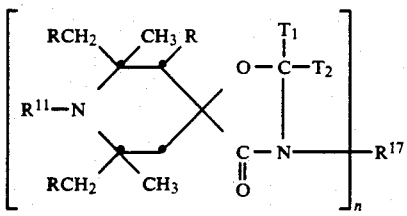

(XC)

wherein n is 1 or 2, R and $R^{11}$ are as defined under a), $R^{16}$ is hydrogen, $C_1$–$C_{12}$alkyl, allyl, benzyl, glycidyl or $C_2$–$C_6$alkoxyalkyl and when n is 1, $R^{17}$ is hydrogen, $C_1$–$C_{12}$alkyl, $C_3$–$C_5$alkenyl, $C_7$–$C_9$aralkyl, $C_5$–$C_7$cycloalkyl, $C_2$–$C_4$hydroxyalkyl, $C_2$–$C_6$alkoxyalkyl, $C_6$–$C_{10}$aryl, glycidyl or a group of the formula $—(CH_2)_p—COO—Q$ or the formula $—(CH_2)_p—O—CO—Q$ wherein p is 1 or 2 and Q is $C_1$–$C_4$alkyl or phenyl, and when n is 2, $R^{17}$ is $C_2$–$C_{12}$alkylene, $C_4$–$C_{12}$alkenylene, $C_6$–$C_{12}$arylene, a group $—CH_2—CH(OH)—CH_2—O—D—O—CH_2—CH(OH)—CH_2—$ wherein D is $C_2$–$C_{10}$alkylene, $C_6$–$C_{15}$arylene or $C_6$–$C_{12}$cycloalkylene, or a group $—CH_2CH(OZ')CH_2—(OCH_2—(OZ')CH_2)_2—$ wherein Z' is hydrogen, $C_{1-C18}$alkyl, allyl, benzyl, $C_2$–$C_{12}$alkanoyl or benzoyl, $T_1$ and $T_2$, each independently of the other, are hydrogen, $C_1$–$C_{18}$alkyl or unsubstituted or halo- or $C_1$–$C_4$alkyl-substituted $C_6$–$C_{10}$aryl or $C_7$–$C_9$aralkyl, or $T_1$ and $T_2$ together with the carbon atom bonding them form a $C_5$–$C_{12}$cycloalkane ring.

When any substitutes are $C_1$–$C_{12}$alkyl, they are, for example, methyl, ethyl, n-propyl, n-butyl, sec.-butyl, tert.-butyl, n-hexyl, n-octyl, 2-ethylhexyl, n-nonyl, n-decyl, n-undecyl or n-dodecyl.

Any substituents $C_1$–$C_{18}$alkyl may be, for example, the groups listed above and in addition, for example, n-tridecyl, n-tetradecyl, n-hexadecyl or n-octadecyl.

When any substituents are $C_2$–$C_6$alkoxyalkyl, they are, for example, methoxymethyl, ethoxymethyl, propoxymethyl, tert.-butoxymethyl, ethoxyethyl, ethoxypropyl, n-butoxyethyl, tert.-butoxyethyl, isopropoxyethyl or propoxypropyl.

When $R^{17}$ is $C_3$–$C_5$alkenyl, it is, for example, 1-propenyl, allyl, methallyl, 2-butenyl or 2-pentenyl.

$R^{17}$, $T_1$ and $T_2$ as $C_7$–$C_9$aralkyl are especially phenethyl or more especially benzyl. When $T_1$ and $T_2$ together with the carbon atom form a cycloalkane ring, this may be, for example, a cyclopentane, cyclohexane, cyclooctane or cyclododecane ring.

When $R^{17}$ is $C_2$–$C_4$hydroxyalkyl, it is, for example, 2-hydroxyethyl, 2-hydroxypropyl, 2-hydroxybutyl or 4-hydroxybutyl.

$R^{17}$, $T_1$ and $T_2$ as $C_6$–$C_{10}$aryl are especially phenyl, α- or β-naphthyl that are unsubstituted or substituted by halogen or $C_1$–$C_4$alkyl.

When $R^{17}$ is $C_2$–$C_{12}$alkylene, it is, for example, ethylene, propylene, 2,2-dimethylpropylene, tetramethylene, hexamethylene, octamethylene, decamethylene or dodecamethylene.

$R^{17}$ as $C_4$–$C_{12}$alkenylene is especially 2-butenylene, 2-pentenylene or 3-hexenylene.

When $R^{17}$ is $C_6$–$C_{12}$arylene, it is, for example, o-, m- or p-phenylene, 1,4-naphthylene or 4,4'-diphenylene.

When Z' is $C_2$–$C_{12}$alkanoyl, it is, for example, propionyl, butyryl, octanoyl, dodecanoyl, but preferably acetyl.

D as $C_2$–$C_{10}$alkylene, $C_6$–$C_{15}$arylene or $C_6$–$C_{12}$cycloalkylene is as defined under b).

The following compounds are examples of polyalkylpiperidine compounds of this class:

56) 3-benzyl-1,3,8-triaza-7,7,9,9-tetramethylspiro[4.5]decane-2,4-dione
57) 3-n-octyl-1,3,8-triaza-7,7,9,9-tetramethylspiro[4.5]decane-2,4-dione
58) 3-allyl-1,3,8-triaza-1,7,7,9,9-pentamethylspiro[4.5]decane-2,4-dione
59) 3-glycidyl-1,3,8-triaza-7,7,8,9,9-pentamethylspiro[4.5]decane-2,4-dione
60) 1,3,7,7,8,9,9-heptamethyl-1,3,8-triazaspiro[4.5]decane-2,4-dione
61) 2-isopropyl-7,7,9,9-tetramethyl-1-oxa-3,8-diaza-4-oxospiro[4.5]decane
62) 2,2-dibutyl-7,7,9,9-tetramethyl-1-oxa-3,8-diaza-4-oxospiro[4.5]decane
63) 2,2,4,4-tetramethyl-7-oxa-3,20-diaza-21-oxodispiro[5.1.11.2]-heneicosane
64) 2-butyl-7,7,9,9-tetramethyl-1-oxa-4,8-diaza-3-oxospiro[4.5]decane
65) 8-acetyl-3-dodecyl-1,3,8-triaza-7,7,9,9-tetramethylspiro[4.5]decane-2,4-dione or the compounds of the following formulae:

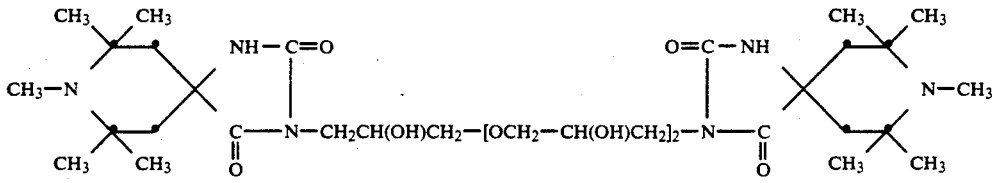

66)

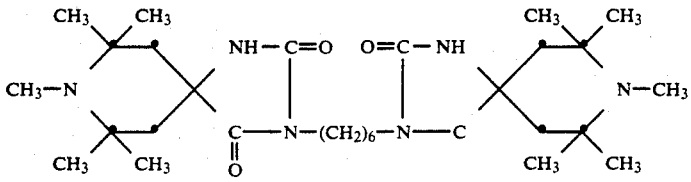

67)

-continued

68)

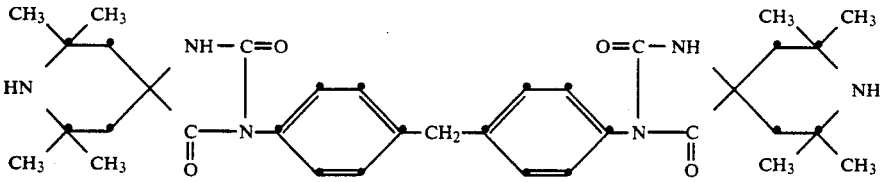

69)

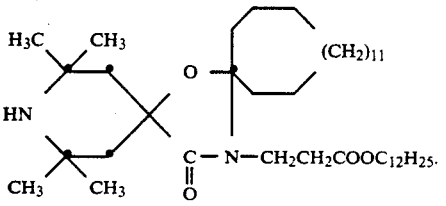

e) Compounds of formula XI (XI)

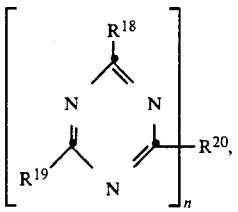

wherein n is 1 or 2 and $R^{18}$ is a group of the formula

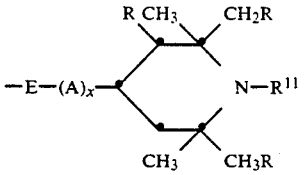

wherein R and $R^{11}$ are as defined under a), E is —O— or —$NR^{11}$—, A is $C_2$-$C_6$alkylene or —$(CH_2)_3$—O— and x is 0 or 1, $R^{19}$ has the same meaning as $R^{18}$ or is one of the groups —$NR^{21}R^{22}$, —$OR^{23}$, —$NHCH_2OR^{23}$ or —$N(CH_2OR^{23})_2$, and when n is 1, $R^{20}$ has the same meaning as $R^{18}$ or $R^{19}$, and when n is 2, $R^{20}$ is a group —E—B—E— wherein B is $C_2$-$C_6$alkylene optionally interrupted by —$N(R^{21})$—, $R^{21}$ is $C_1$-$C_{12}$alkyl, cyclohexyl, benzyl or $C_1$-$C_4$hydroxyalkyl or a group of the formula

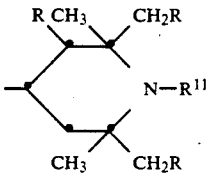

$R^{22}$ is $C_1$-$C_{12}$alkyl, cyclohexyl, benzyl or $C_1$-$C_4$-hyroxyalkyl and $R^{23}$ is hydrogen, $C_1$-$C_{12}$alkyl or phenyl, or $R^{21}$ and $R^{22}$ together are $C_4$-$C_5$-alkylene or $C_4$-$C_5$oxaalkylene, for example

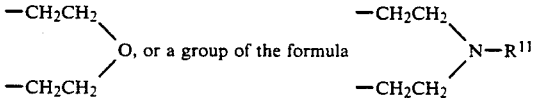

or $R^{21}$ and $R^{22}$ are each a group of the formula

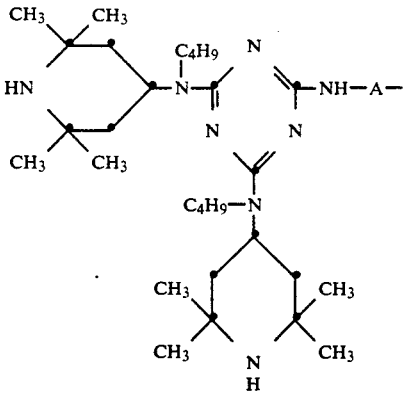

When any substituents are $C_1$-$C_{12}$alkyl, they are, for example, methyl, ethyl, n-propyl, n-butyl, sec.-butyl, tert.-butyl, n-hexyl, n-octyl, 2-ethylhexyl, n-nonyl, n-decyl, n-undecyl or n-dodecyl.

When any substituents are $C_1$-$C_4$hydroxyalkyl, they are, for example, 2-hydroxyethyl, 2-hydroxypropyl, 3-hydroxypropyl, 2-hydroxybutyl or 4-hydroxybutyl.

When A is $C_2$-$C_6$alkylene, it is, for example, ethylene, propylene, 2,2-dimethylpropylene, tetramethylene or hexamethylene.

When $R^{21}$ and $R^{22}$ together are $C_4$-$C_5$alkylene or oxaalkylene, they are, for example, tetramethylene, pentamethylene or 3-oxapentamethylene.

The compounds of the following formulae are examples of polyalkylpiperidine compounds of this class:

70)
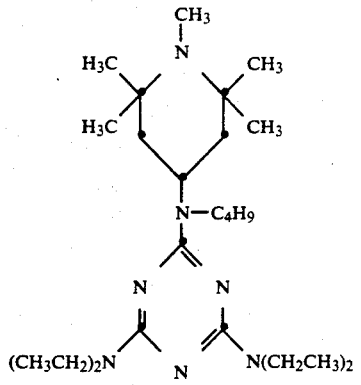
71)
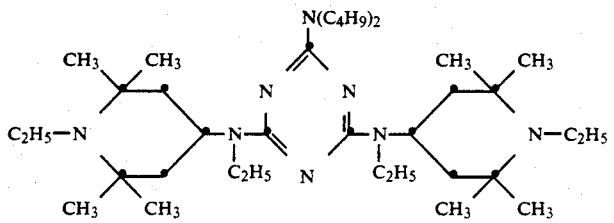
72)
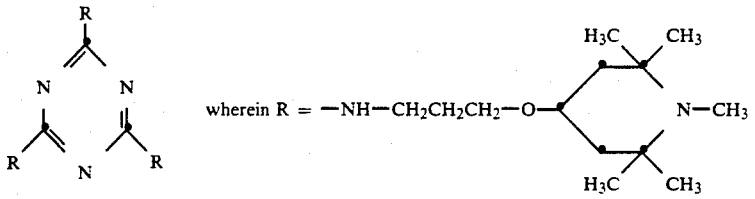
73)
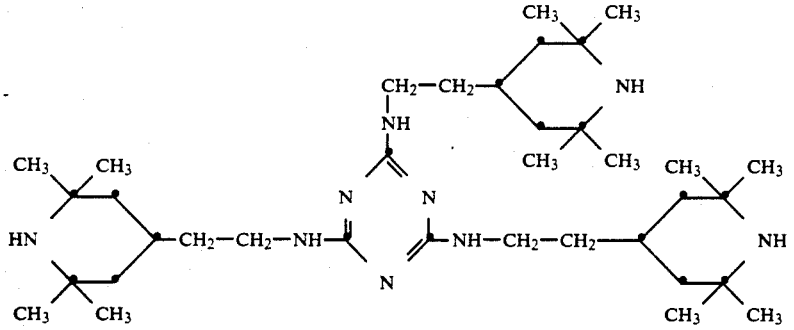
74)
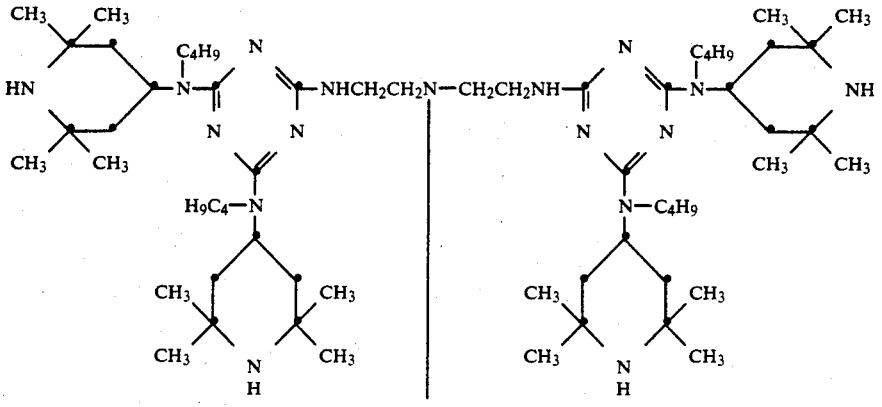

-continued
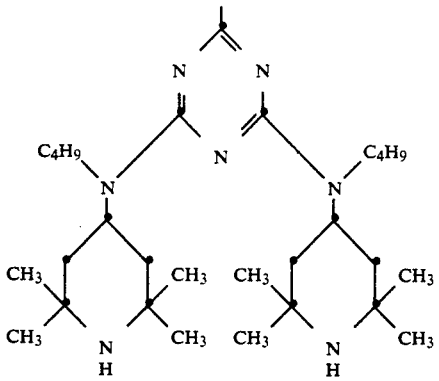
75)
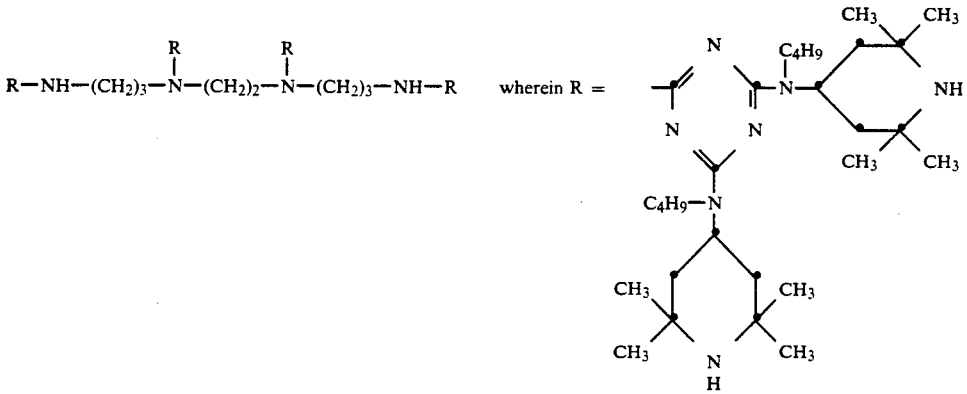
76)
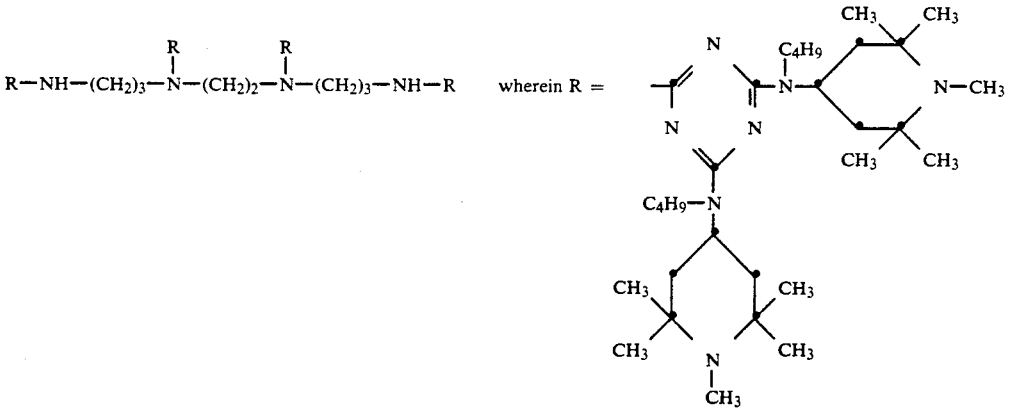
77)
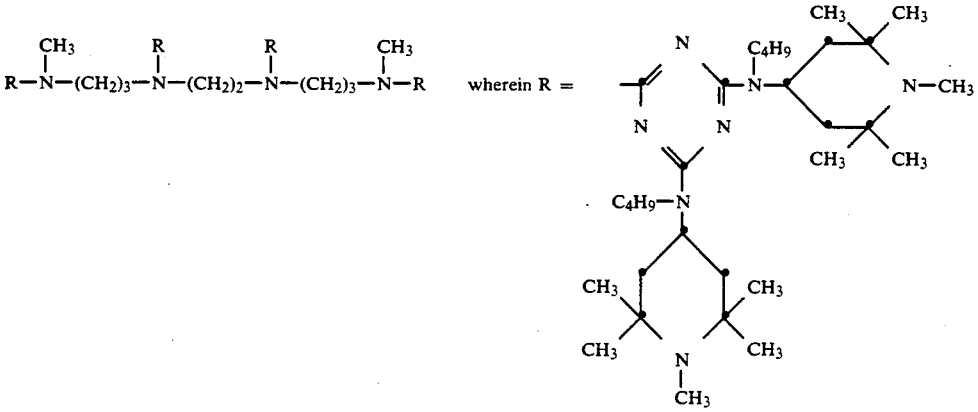

-continued

78)

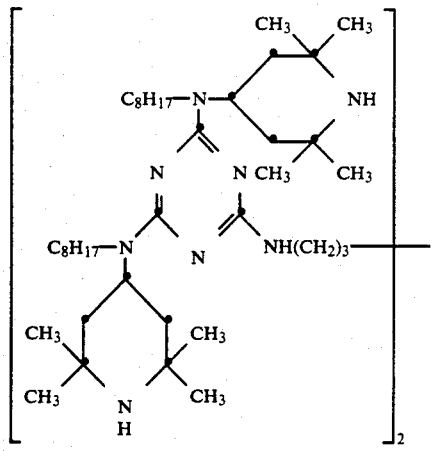

79)

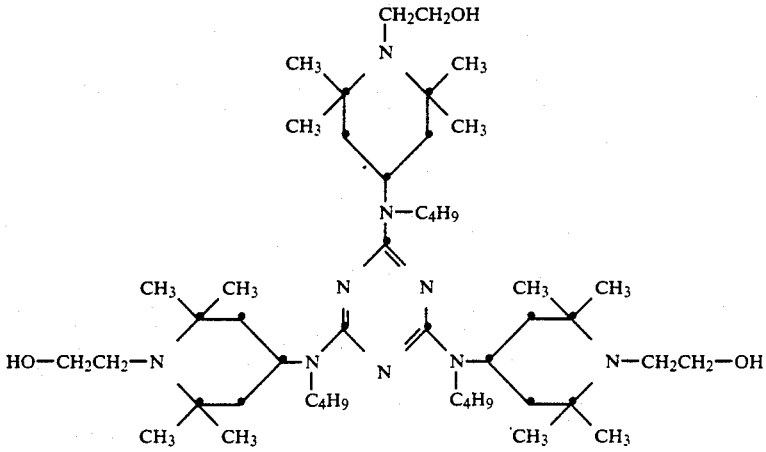

80)

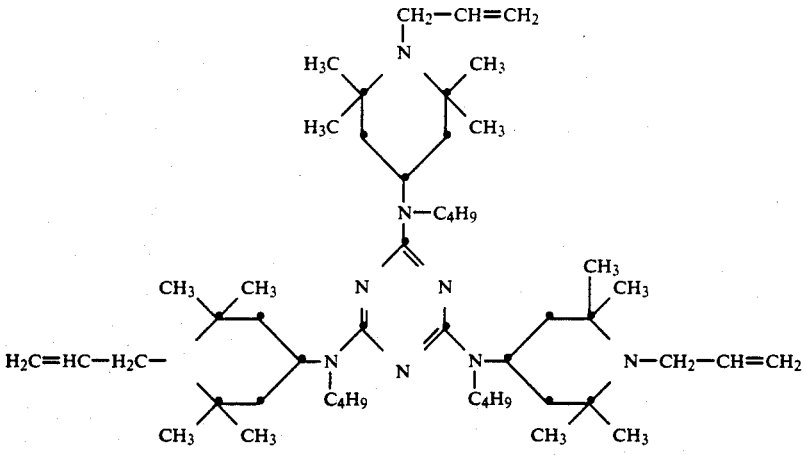

f) Oligomeric or polymeric compounds of which the recurring structural unit contains a 2,2,6,6-tetraalkylpiperidine radical of formula (VI), especially polyesters, polyethers, polyamides, polyamines, polyurethanes, polyureas, polyaminotriazines, poly(meth)acrylates, poly(meth)acrylamides and copolymers thereof that contain such radicals.

The compounds of the following formulae wherein m is from 2 to approximately 200 are examples of 2,2,6,6-polyalkylpiperidine light stabilisers of this class:

81)

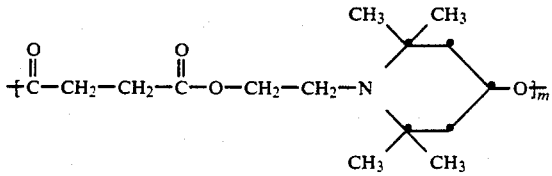

-continued
82)
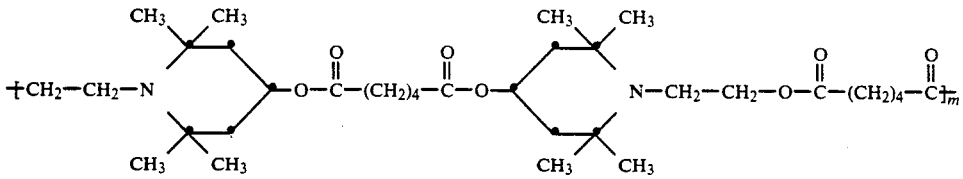
83)
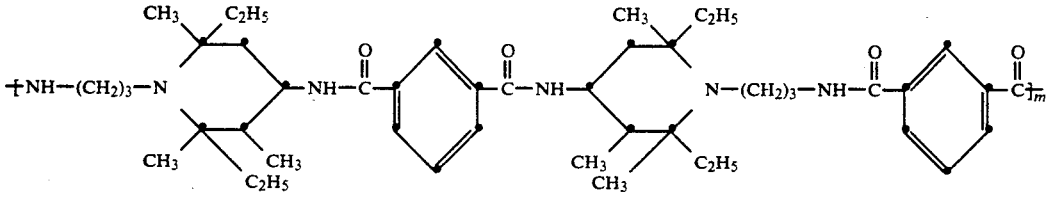
84)
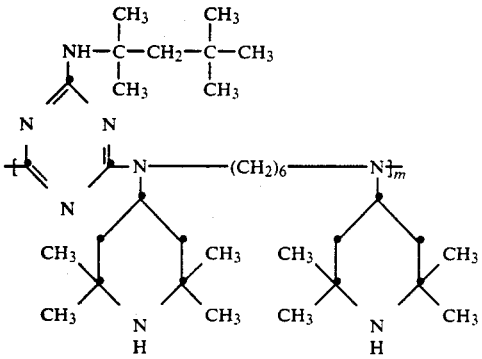
85)
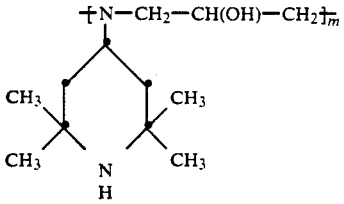
86)
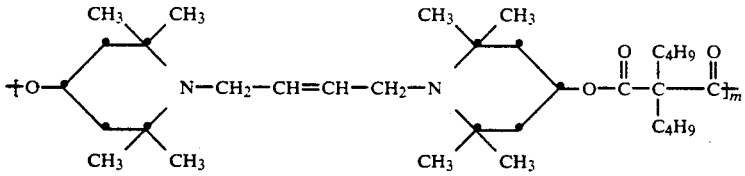
87)
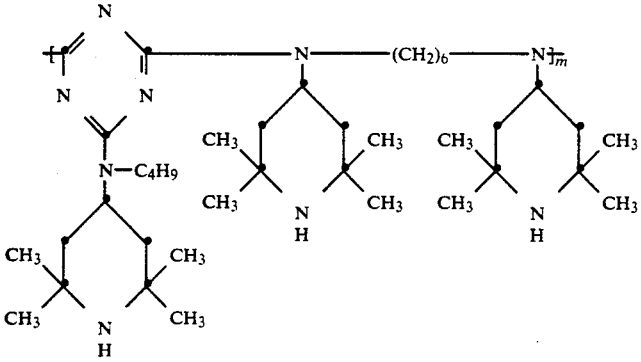

-continued
88)
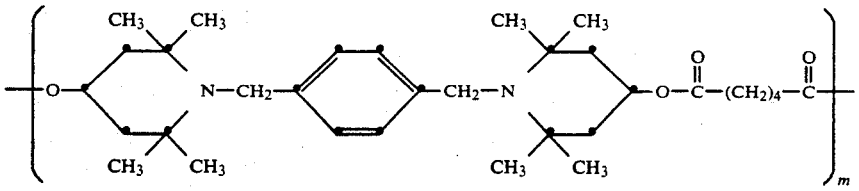
89)
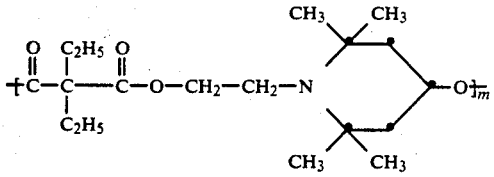
90)
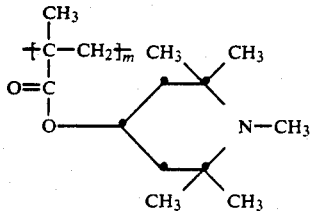
91)
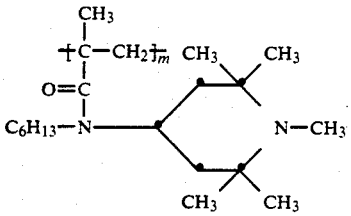
92)
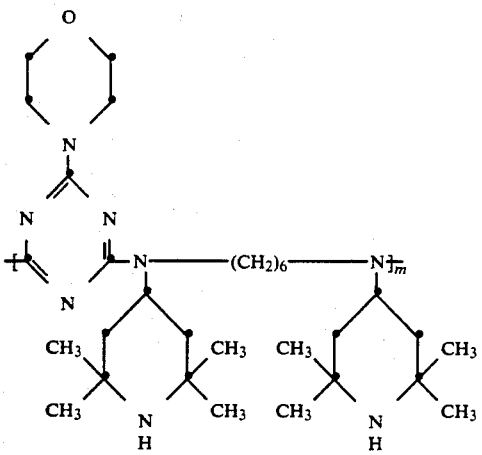
93)
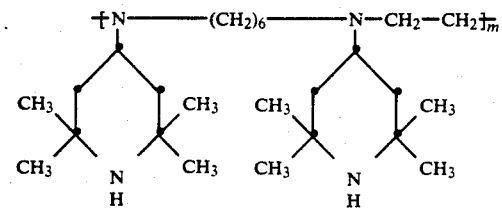

-continued

94)

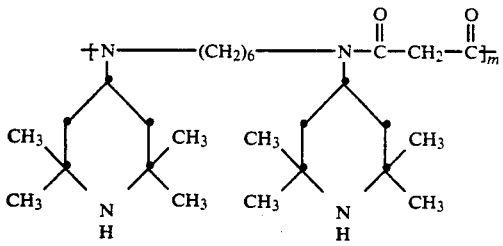

g) Compounds of formula XII

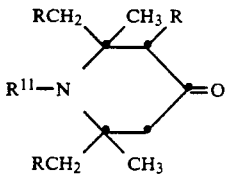

(XII)

wherein R and $R^{11}$ are as defined under a).

Compounds of formula XII wherein R is hydrogen or methyl and $R^{11}$ is hydrogen or methyl are preferred.

Examples of such compounds are:

95) 2,2,6,6-tetramethyl-4-piperidone (triacetoneamine)
96) 1,2,2,6,6-pentamethyl-4-piperidone
97) 2,2,6,6-tetramethyl-4-piperidon-1-oxyl
98) 2,3,6-trimethyl-2,6-diethyl-4-piperidone.

Component D) can also be a phenol of general formula V, as described above.

Advantageous compounds of formula V are those wherein A is $-C_qH_{2q}-S_z-Y$, q is 0 or 1 and z is 1 or 2 and Y is alkyl having from 4 to 18 carbon atoms, phenyl, $C_2$-$C_8$alkyl-substituted phenyl or

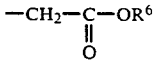

wherein $R^6$ is $C_1$-$C_{18}$alkyl, and preferably A is $-CH_2-S-Y$ wherein Y is $C_8$-$C_{12}$alkyl or

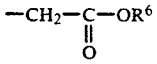

and $R^6$ is $C_6$-$C_{18}$alkyl and especially iso$C_8$-$C_{13}$alkyl.

In preferred compounds of formula V, A is —H, $C_1$-$C_{18}$alkyl, especially

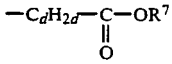

wherein d is 2 or 3 and $R^7$ is alkyl having from 1 to 18 carbon atoms, and more especially

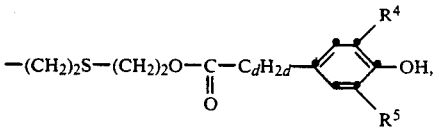

-continued

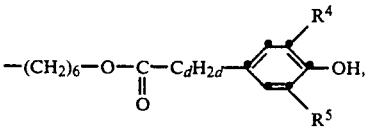

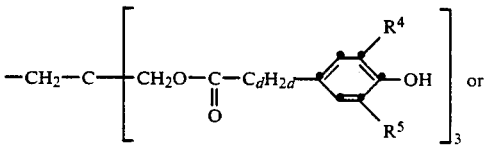

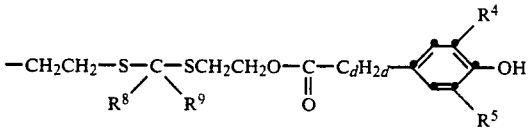

wherein d is in each case 2 or 3, $R^4$ and $R^5$ are as defined above and $R^8$ and $R^9$, each independently of the other, are —H, $C_1$-$C_9$alkyl or phenyl or

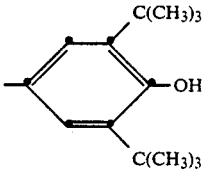

$R^7$ is preferably

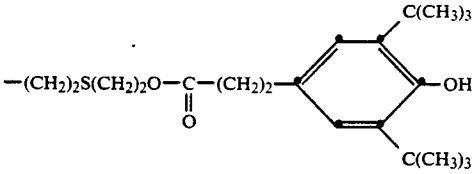

In another advantageous form, A in the compounds of formula V is

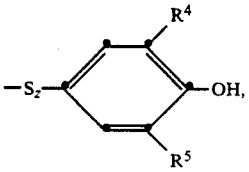

wherein z is 1 or 2, $R^4$ is —H or $C_1$-$C_5$alkyl and $R^5$ is $C_1$-$C_5$alkyl and preferably $R^4$ and $R^5$ are each tert.-butyl.

Especially advantageous formulations are those containing compounds of formula V wherein $R^4$ is hydrogen or alkyl having from 1 to 4 carbon atoms and preferably alkyl having from 1 to 4 carbon atoms and especially tert.-butyl.

An advantageous embodiment is provided by formulations wherein $R^5$ in compounds of formula V is alkyl having from 1 to 4 carbon atoms and preferably tert.-butyl.

Preferred compounds of formula V also include

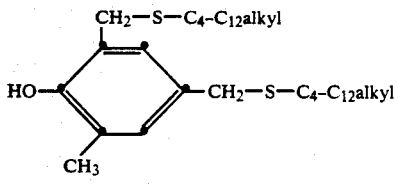

and/or

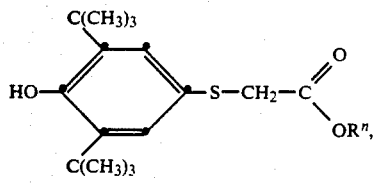

wherein $R^n$ is $C_6$–$C_{18}$alkyl and especially iso$C_8H_{17}$ or iso$C_{13}H_{27}$.

When $R^4$, $R^5$, $R^6$, $R^7$, A, R' and R'' are alkyl having from 1 to 24 carbon atoms, they are accordingly, for example, methyl, ethyl, propyl, isopropyl, n-butyl, isobutyl, 2-butyl, tert.-butyl, pentyl, isopentyl, hexyl, heptyl, 3-heptyl, octyl, 2-ethylhexyl, nonyl, decyl, undecyl, dodecyl, tridecyl, tetradecyl, pentadecyl, hexadecyl, heptadecyl or octadecyl, and also isoamyl, 2-ethylbutyl, 1-methylpentyl, 1,3-dimethylbutyl, 1,1,3,3-tetramethylbutyl, 1-methylhexyl, isoheptyl, 1-methylheptyl, 1,1,3-trimethylhexyl, 1-methylundecyl, eicosyl, heneicosyl and docosyl.

Preferred as alkyl $R^7$ is $C_1$–$C_{18}$alkyl, with methyl, octyl, nonyl, tridecyl and octadecyl being of particular interest.

In the case of $R^4$ and $R^5$, cycloalkyl having from 5 to 12 carbon atoms can be cyclopentyl, cyclohexyl, cycloheptyl, cyclooctyl, cyclononyl, cyclodecyl, cycloundecyl or cyclododecyl, preferably cyclohexyl, or, furthermore, the $C_5$–$C_{12}$cycloalkyl group can be substituted by $C_1$–$C_4$alkyl and may be, for example, 2- or 4-methylcyclohexyl, dimethylcyclohexyl, trimethylcyclohexyl or tert.-butylcyclohexyl.

Accordingly, examples of $C_1$–$C_{18}$alkyl Y or $R^{10}$ can be found in the above list of alkyl radicals.

Alkyl radicals having from 8 to 13 carbon atoms, as indicated for $R^6$, can be found in the above examples; iso-compounds are 2-ethylhexyl, 1,1,3,3-tetramethylbutyl, 1-methylheptyl, 1,1,3-trimethylhexyl and 1-methylundecyl. Examples of the alkyl and cycloalkyl groups indicated for $R^8$ and $R^9$ can also be found in the above lists according to the carbon chain length.

Preferred as alkyl groups A are methyl, ethyl, propyl and butyl groups, especially methyl and tert.-butyl.

When A is the radical $—C_qH_{2q}—N(R')(R'')$, typical examples thereof are $—CH_2—N(C_1$–$C_4alkyl)_2$ and especially $—CH_2—N(CH_3)_2$.

Compounds B) of general formula I are known per se and can be prepared, for example, as described in Houben-Weyl, "Methoden der organischen Chemie", Vol. 12, Part 2, 4th Edition, G. Thieme Verlag, Stuttgart 1964, pages 53–77, 143–210, 226–274, 299–376 and 587–748.

The compounds of general formula II are likewise known per se and can be prepared, for example, by alkylation of diphenylamine. A preferred process for the preparation of especially valuable industrial mixtures of alkylated diphenylamines, as described above, comprises the reaction of diphenylamine with diisobutylene, the reaction of diphenylamine being carried out with an excess of diisobutylene in the presence of an active alumina catalyst, the concentration of diisobutylene being kept substantially constant during the course of the reaction, the reaction temperature being at least 160° C., the reaction being carried out until the content of 4,4'-di-tert.-octyldiphenylamine, based on the reaction mass without the catalyst, is less than 29% by weight, preferably less than 25% by weight, and the content of diphenylamine is less than 5% by weight, the catalyst and unreacted diisobutylene being removed and the resulting liquid product being isolated.

The process per se is described in detail in EP-A-0 149 422.

The most important process steps are distinguished, for example, by the fact that the reaction is advantageously carried out by introducing the diphenylamine and the catalyst into the reaction vessel and heating the mixture to at least 160° C., preferably at least 165° C., preferably with stirring. Diisobutylene can then be metered into the hot mixture of diphenylamine and catalyst in such a manner that the temperature of the mixture does not fall below 160° C., and preferably does not fall below 165° C.

With heating and stirring, the temperature is maintained at at least 160° C. and frequent samples are taken until the product, without the catalyst, contains less than 29% by weight 4,4'-di-tert.-octyldiphenylamine and less than 10% by weight diphenylamine.

The temperature at which the process is performed is at least 160° C. but may be considerably higher, for example up to 250° C.

To reduce the risk of degradation, the usual maximum temperature is approximately 190° C.

The period of time over which the diisobutylene can be added to the hot mixture of diphenylamine and catalyst can vary within a wide range in dependence upon the reaction temperature, but is usually within the range of 3 to 30 hours.

The molar ratio of diphenylamine to diisobutylene can vary over a wide range, but is preferably maintained within the range of from 1:1.11 to 1:2.5, especially from 1:1.75, in order to reduce expenditure on starting material and to minimise the period of diisobutylene addition.

The recovery of the catalyst is advantageously effected by vacuum filtration of the hot reaction mixture. The recovery of excess diisobutylene can readily be effected by vacuum distillation of the reaction mixture.

The active alumina catalyst used in the process preferably has a free moisture content of less than 10% by weight, especially less than 5% by weight.

Commercially available catalysts that have proved effective are, for example, Fulcat® 14, Fulmont® 700C, Fulmont® 237, catalyst K-10 (Süd-Chemie) and preferably Fulcat® 22B (an alumina activated with sulfuric acid). The Fulcat and Fulmont catalysts are commercially available from Laporte Industries.

The compounds of formula III are obtainable, for example, by reaction of diphenylamine with sulfur (U.S. Pat. No. 2,433,658).

The compounds of the series of the cyclic sterically hindered amines can be obtained according to processes known per se which can be found in the relevant literature.

The compounds of the series of the phenols having the general formula V can be prepared, for example, by the processes according to DE-A 23 64 121 or DE-A 23 64 126.

As mentioned above, the formulations according to the invention contain A) a lubricant and an at least ternary mixture of compounds that are designated B), C) and D) and are described in detail above.

For C) it is possible to use both compounds of general formula II and compounds of general formula III, and mixtures of compounds of formulae II and III, and for D) it is possible to use both compounds of the series of the sterically hindered amines and of the series of the phenols of general formula V, and mixtures of sterically hindered amines and phenols of general formula V. The meanings of C) and D) are explained above.

Preferred formulations are those containing

A) a lubricant and

B) a compound

O,O-bis-2-ethylhexylsodium dithiophosphate, O,O-bis-2-ethylhexylsodium thionophosphate, O,O-bis-2-methylpropylsodium dithiophosphate, O,O-bis-nonylphenylsodium dithiophosphate or S-[O,O-bis-2-ethylhexylthiophosphoryl]-sodium thioglycolate, C) a mixture of diphenylamine compounds containing

| | |
|---|---|
| 1 to 5% by weight | a) diphenylamine, |
| 8 to 18% by weight | b) 4-tert.-butyldiphenylamine, |
| 21 to 31% by weight | c) one or more of the compounds |
| | i) 4-tert.-octyldiphenylamine, |
| | ii) 4,4'-di-tert.-butyldiphenylamine, |
| | iii) 2,4,4'-tris-tert.-butyldiphenylamine, |
| 20 to 31% by weight | d) one or more of the compounds |
| | i) 4-tert.-butyl-4'-tert.-octyldiphenylamine, |
| | ii) 2,2'-or 2,4'-di-tert.-octyldiphenylamine, |
| | iii) 2,4-di-tert.-butyl-4'-tert.-octyldiphenylamine, and |
| 15 to 29% by weight | e) the compound |
| | i) 4,4'-di-tert.-octyldiphenylamine or the compounds |
| | i) 4,4'-di-tert.-octyldiphenylamine and |
| | ii) 2,4-di-tert.-octyl-4'-tert.-butyldiphenylamine; |

and D) one of the compounds di-(2,2,6,6-tetramethylpiperidin-4-yl)-sebacate, N,N'-bis-(2,2,6,6-tetramethylpiperidin-4-yl)-hexamethylene-1,6-diamine or 2,2-thiodiethylenebis-3,5-di-tert.-butyl-4-hydroxyhydrocinnamate or pentaerythrityltetrakis-[3-(3,5-di-tert.-butyl-4-hydroxyphenyl)-propionate].

The formulations according to the present invention can contain A) a lubricant and, for example, from 0.01 to 10% by weight, based on the formulation, of a mixture of B), C) and D), as described above.

The formulations advantageously contain from 0.1 to 5% by weight, based on the formulation, of a mixture of B), C) and D).

The formulation preferably contains from 0.3 to 3% by weight, especially from 0.5 to 2.0% by weight and more especially from 1.0 to 1.8% by weight, of the mixture of B), C) and D).

The mixture of B), C) and D) can contain, for example, from 20 to 88% by weight B), from 10 to 60% by weight C) and from 2 to 20% by weight D), the percentages being based on the mixture. The mixture of B), C) and D) preferably contains from 30 to 80% by weight B), from 10 to 60% by weight C) and from 4 to 15% by weight D).

Mixtures of B), C) and D) containing from 40 to 65% B), from 15 to 50% C) and from 4 to 10% D) are especially preferred.

Mixtures of B), C) and D) containing from 60 to 65% B), from 25 to 35% C) and from 5 to 10% D) are more especially preferred.

In a further especially preferred embodiment, the proportion by weight of compounds of series C) in the mixture is greater than the proportion by weight of compounds of series D), with the ratio of C) to D) being especially 3–5:1, a ratio of C) to D) of 4:1 being preferred.

Very especially preferred formulations are those given below, which contain

A) a lubricant and as B) from 0.8 to 1.2% by weight O,O-bis-2-ethylhexylsodium dithiophosphate, O,O-bis-2-ethylhexylsodium thionophosphate, O,O-bis-2-methylpropylsodium dithiophosphate, O,O-bis-nonylphenylsodium dithiophosphate or S-[O,O-bis-2-ethylhexylthiophosphoryl]-sodium thioglycolate, as C) from 0.45 to 0.5% by weight industrial diphenylamine mixture and as D) from 0.1 to 0.15% by weight di-(2,2,6,6-tetramethylpiperidin-4-yl)-sebacate, 2,2-thiodiethylene glycol-bis-(3,5-di-tert.-butyl-4-hydroxyhydrocinnamate), N,N'-bis-(2,2,6,6-tetramethylpiperidin-4-yl)-hexamethylene-1,6-diamine or pentaerythrityl-tetrakis-[3-(3,5-di-tert.-butyl-4-hydroxyphenyl)-propionate].

The above percentages by weight for B), C) and D) relate to the formulation.

The industrial diphenylamine mixture indicated above under C) is preferably a mixture containing 3.2% diphenylamine, 13.2% mono-tert.-butyldiphenylamines, 25.3% mono-tert.-octyldiphenylamines and di-tert.-butyldiphenylamines, 24.2% tert.-butyl-tert.-octyldiphenylamines, 24.3% di-tert.-octyldiphenylamines and other higher alkylated diphenylamines, the content of 4,4'-di-tert.-octyldiphenylamine being 18.2%, and further relatively small amounts of diphenylamines having partially modified side chains and polymers to make up to 100%.

Additives B), C) and D) can be mixed with the lubricant in a manner known per se. Additives B), C) and D) can be added to the lubricant separately or may be mixed together in the given quantity ratios before being added to the lubricant. For example, the compounds are readily soluble in oil. It is also possible to prepare a so-called master batch which can be diluted with the corresponding lubricant as required to give working concentrations.

The lubricants in question are based, for example, on mineral or synthetic oils or mixtures thereof. The lubricants are known to the person skilled in the art and are described in the relevant technical literature, for example in Dieter Klamann, "Schmierstoffe und verwandte Produkte" (Verlag Chemie, Weinheim, 1982), in Schewe-Kobek, "Das Schmiermittel-Taschenbuch" (Dr. Alfred Hüthig-Verlag, Heidelberg, 1974) and in "Ullmanns Enzyklopädie der technischen Chemie", Vol. 13, pages 85–94 (Verlag Chemie, Weinheim, 1977).

The lubricants are especially oils, but fats, for example those based on a mineral oil, are included.

A further group of lubricants which may be used comprises vegetable and animal oils, fats, tallows and waxes or mixtures thereof with one another, or mixtures with the mentioned mineral or synthetic oils.

The mineral oils are based especially on hydrocarbon compounds.

Examples of synthetic lubricants include lubricants based on aliphatic or aromatic carboxy esters, polymeric esters, polyalkylene oxides, phosphoric acid esters, poly-α-olefins or silicones, a diester of a divalent acid with a monovalent alcohol, for example dioctyl sebacate or dinonyl adipate, a triester of trimethylolpropane with a monovalent acid or with a mixture of such acids, for example trimethylolpropane tripelargonate, trimethylolpropane tricaprylate or mixtures thereof, a tetraester of pentaerythritol with a monovalent acid or with a mixture of such acids, for example pentaerythritol tetracaprylate, or a complex ester of mono-valent and divalent acids with polyvalent alcohols, for example a complex ester of trimethylolpropane with caprylic and sebacic acid or of a mixture thereof. In addition to mineral oils there are especially suitable, for example, poly-α-olefins, ester-based lubricants, phosphates, glycols, polyglycols and polyalkylene glycols, and mixtures thereof with water.

In these formulations, partially synthetic lubricants are preferred and synthetic lubricants are especially preferred. Especially interesting synthetic lubricants are the trimellitic acid esters, pentaerythritol esters, poly-α-olefins and adipic acid esters, and mixtures of such lubricants with one another.

The lubricants can also contain, for example, solid lubricants, in the amounts customary per se. Such solid lubricants may be, for example, graphite, boron nitride, molybdenum disulfide or polytetrafluoroethylene.

The lubricants can additionally contain other additives which are added to enhance further the basic properties thereof. These include further anti-oxidants, metal deactivators, rust inhibitors, viscosity index enhancers, pour-point depressors, dispersants, detergents and other anti-wear additives. Examples thereof are:

EXAMPLES OF PHENOLIC ANTI-OXIDANTS

1. Alkylated Monophenols 2,4,6-Tricyclohexylphenol, 2,6-di-tert.-butyl-4-methoxymethylphenol, o-tert.-butylphenol.

2. Alkylated Hydroquinones 2,6-Di-tert.-butyl-4-methoxyphenol, 2,5-di-tert.-butylhydroquinone, 2,5-di-tert.-amylhydroquinone, 2,6-diphenyl-4-octadecyloxyphenol.

3. Hydroxylated Thiodiphenyl Ethers 2,2'-Thio-bis-(6-tert.-butyl-4-methylphenol), 2,2'-thio-bis-(4-octylphenol), 4,4'-thio-bis-(6-tert.-butyl-3-methylphenol), 4,4'-thio-bis-(6-tert.-butyl-2-methylphenol).

4. Alkylidene Bisphenols 2,2'-Methylene-bis-(6-tert.-butyl-4-methylphenol), 2,2'-methylene-bis-(6-tert.-butyl-4-ethylphenol), 2,2'-methylene-bis-[4-methyl-6-(α-methylcyclohexyl)-phenol], 2,2'-methylene-bis-(4-methyl-6-cyclohexylphenol), 2,2'-methylene-bis-(6-nonyl-4-methylphenol), 2,2'-methylene-bis-(4,6-di-tert.-butylphenol), 2,2'-ethylidene-bis-(4,6-di-tert.-butylphenol), 2,2'-ethylidene-bis-(6-tert.-butyl-4- or -5-isobutylphenol), 2,2'-methylene-bis[6-(α-methylbenzyl)-4-nonylphenol], 2,2'-methylene-bis-[6-(α,α-dimethylbenzyl)-4-nonylphenol], 4,4'-methylene-bis-(2,6-di-tert.-butylphenol), 4,4'-methylene-bis-(6-tert.-butyl-2-methylphenol), 1,1-bis-(5-tert.-butyl-4-hydroxy-2-methylphenyl)-butane, 2,6-di-(3-tert.-butyl-5-methyl-2-hydroxybenzyl)-4-methylphenol, 1,1,3-tris-(5-tert.-butyl-4-hydroxy-2-methylphenyl)-3-n-dodecylmercaptobutane, ethylene glycol bis-[3,3-bis-(3'-tert.-butyl-4'-hydroxyphenyl)-butyrate], bis-(3-tert.-butyl-4-hydroxy-5-methylphenyl)-dicyclopentadiene, bis-[2-(3'-tert.-butyl-2'-hydroxy-5'-methylbenzyl)-6-tert.-butyl-4-methylphenyl]-terephthalate.

5. Benzyl Compounds 1,3,5-Tri-(3,5-di-tert.-butyl-4-hydroxybenzyl)-2,4,6-trimethylbenzene, bis-(3,5-di-tert.-butyl-4-hydroxybenzyl) sulfide, 3,5-di-tert.-butyl-4-hydroxybenzylmercaptoacetic acid isooctyl ester, bis-(4-tert.-butyl-3-hydroxy-2,6-dimethylbenzyl)-dithiolterephthalate, 1,3,5-tris-(3,5-di-tert.-butyl-4-hydroxybenzyl)-isocyanurate, 1,3,5-tris-(4-tert.-butyl-3-hydroxy-2,6-dimethylbenzyl)-isocyanurate, 3,5-di-tert.-butyl-4-hydroxybenzylphosphonic acid dioctadecyl ester, 3,5-di-tert.-butyl-4-hydroxybenzylphosphonic acid monoethyl ester, calcium salt.

6. Acylaminophenols

4-Hydroxylauric acid anilide, 4-hydroxystearic acid anilide, 2,4-bis-octylmercapto-6-(3,5-di-tert.-butyl-4-hydroxyanilino)-s-triazine, N-(3,5-di-tert.-butyl-4-hydroxyphenyl)-carbamic acid octyl ester.

7. Esters of β-(3,5-di-tert.-butyl-4-hydroxyphenyl)-Propionic Acid with mono- or poly-valent alcohols, for example with methanol, diethylene glycol, triethylene glycol, neopentyl glycol, tris-hydroxyethyl-isocyanurate, bis-hydroxyethyl oxalic acid diamide.

8. Esters of β-(5-tert.-butyl-4-hydroxy-3-methylphenyl)-Propionic Acid with mono- or poly-valent alcohols, for example with methanol, diethylene glycol, triethylene glycol, neopentyl glycol, tris-hydroxyethyl-isocyanurate, dihydroxyethyloxalic acid diamide.

9. Amides of β-(3,5-di-tert.-butyl-4-hydroxyphenyl)-Propionic Acid for example N,N'-bis-(3,5-di-tert.-butyl-4-hydroxyphenylpropionyl)-hexamethylenediamine, N,N'-bis-(3,5-di-tert.-butyl-4-hydroxyphenylpropionyl)-trimethylenediamine, N,N'-bis-(3,5-di-tert.-butyl-4-hydroxyphenylpropionyl)-hydrazine.

Examples of Aminic Anti-Oxidants

N,N'-diisopropyl-p-phenylenediamine, N,N'-di-sec.-butyl-p-phenylenediamine, N,N'-bis-(1,4-dimethylpentyl)-p-phenylenediamine, N,N'-bis-(1-ethyl-3-methylpentyl)-p-phenylenediamine, N,N'-bis-(1-methylheptyl)-p-phenylenediamine, N,N'-dicyclohexyl-p-phenylenediamine, N,N'-diphenyl-p-phenylenediamine, N,N'-di-(naphth-2-yl)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfonamido)- diphenylamine, N,N'-dimethyl-N,N'-di-sec.-butyl-p-phenylenediamine, N-allyldiphenylamine, 4-isopropoxy-diphenylamine, N-phenyl-1-naphthylamine, N-phenyl-2-naphthylamine, 4-n-butylaminophenol, 4-butyrylaminophenol, 4-nonanoylaminophenol, 4-dodecanoylaminophenol, 4-octadecanoylaminophenol, di-(4-methoxyphenyl)-amine, 2,6-di-tert.-butyl-4-dimethylaminomethylphenol, 2,4'-diaminodiphenylmethane, 4,4'-diaminodiphenylmethane, N,N,N',N'-tetramethyl-4,4'-diaminodiphenylmethane, 1,2-di-[(2-methylphenyl)-amino]-ethane, 1,2-di-(phenylamino)-propane, (o-tolyl)-biguanide, di-[4-(1',3'-dimethylbutyl)-phenyl]-amine, 2,3-dihydro-3,3-dimethyl-4H-1,4-benzothiazine, phenothiazine, N-allylphenothiazine.

Examples of Further Anti-Oxidants aliphatic or aromatic phosphites, esters of thiodipropionic acid or thiodiacetic acid, or salts of dithiocarbamic or dithiophosphoric acid.

Examples of metal deactivators, for example for copper, are:

triazoles, benzotriazoles and derivatives thereof, tolutriazoles and derivatives thereof, 2-mercaptobenzothiazole, 2-mercaptobenzotriazole, 2,5-dimercaptobenzotriazole, 2,5-dimercaptobenzothiadiazole, 5,5'-methylene-bisbenzotriazole, 4,5,6,7-tetrahydrobenzotriazole, salicylidenepropylenediamine, salicylaminoguanidine and salts thereof.

Examples of rust inhibitors are:

a) Organic acids, their esters, metal salts and anhydrides, for example: N-oleoylsarcosine, sorbitan monooleate, lead naphthenate, alkenylsuccinic acid anhydride, for example dodecenylsuccinic acid anhydride, alkenylsuccinic acid partial esters and partial amides, 4-nonylphenoxyacetic acid.

b) Nitrogen-containing compounds, for example: I. Primary, secondary or tertiary aliphatic or cycloaliphatic amines and amine salts of organic and inorganic acids, for example oil-soluble alkylammonium carboxylates.

II. Heterocyclic compounds, for example: substituted imidazolines and oxazolines.

c) Phosphorus-containing compounds, for example: amine salts of phosphoric acid partial esters or phosphonic acid partial esters, zinc dialkyl dithiophosphates.

d) Sulfur-containing compounds, for example: barium dinonylnaphthalenesulfonates, calcium petroleum sulfonates.

Examples of viscosity index enhancers are:

polyacrylates, polymethacrylates, vinylpyrrolidone/-methacrylate copolymers, polyvinylpyrrolidones, polybutenes, olefin copolymers, styrene/acrylate copolymers, polyethers.

Examples of pour-point depressors are:

polymethacrylate, alkylated naphthalene derivatives.

Examples of dispersants/surfactants are:

polybutenylsuccinic acid amides or imides, polybutenylphosphonic acid derivatives, basic magnesium, calcium and barium sulfonates and phenolates.

Examples of anti-wear additives are:

sulfur- and/or phosphorus- and/or halogen-containing compounds, such as sulfated vegetable oils, zinc dialkyl dithiophosphates, tritolyl phosphate, chlorinated paraffins, alkyl- and aryl-di- and tri-sulfides, triphenylphosphorothionates, diethanolaminomethyltolyltriazole, di-(2-ethylhexyl)-aminomethyltolyltriazole.

The present invention also includes the use of mixtures of B), C) and D) according to the present invention as anti-oxidants in lubricants and especially in lubricants based on synthetic and partially synthetic oils. The use of the mixtures of B), C) and D) according to the present invention in lubricants for internal combustion engines having self-ignition, for example for internal combustion engines according to the Diesel principle, is especially preferred. The lubricants are preferably provided for use in the lubrication of the crankcase.

The following Examples illustrate the invention in more detail.

All parts and percentages relate to weight, unless otherwise indicated.

EXAMPLES 1 TO 7

The following test samples are prepared:

Oils

Oil A1)

Synthetic oil consisting of 70% by weight pentaerythrityl tetraester and 30% by weight poly-α-olefin containing 8% by weight, based on the synthetic oil, of a commercial additive package containing viscosity index enhancers, dispersants, detergents etc. but no zinc dialkyl dithiophosphate.

Oil A2)

Mineral oil of the SAE 30 type containing 8% by weight, based on the mineral oil, of a commercial additive package containing viscosity index enhancers, dispersants, detergents etc. but no zinc dialkyl dithiophosphate.

Component C)

Industrial diphenylamine mixture consisting of 3.2% diphenylamine, 13.2% mono-tert.-butyldiphenylamines, 25.3% mono-tert.-octyldiphenylamines and di-tert.-butyldiphenylamines, 24.2% tert.-butyl-tert.-octyldiphenylamines, 24.3% di-tert.-octyldiphenylamines and other higher alkylated diphenylamines, the content of 4,4'-di-tert.-octyldiphenylamine being 18.2%, and further relatively small amounts of diphenylamines having partially modified side chains and polymers to make up to 100%.

TABLE

| Formulations containing: | Example | | | | | | |
|---|---|---|---|---|---|---|---|
| | 1 | 2 | 3 | 4 | 5 | 6 | 7 |
| A) oil (see above) to 100% by weight | A 1) | A 1) | A 1) | A 1) | A 1) | A 1) | A 2) |
| B) 0,0-Di(2-ethylhexyl)-sodiumdithiophosphate | 1% | 1% | 1% | | | | |
| 0,0-Di(2-methylpropyl)-sodiumdithiophosphate | | | | 1% | 1% | | 0.69% |
| 0,0-Di(2-ethylhexyl)-sodiumthionophosphate | | | | | | 1.0% | |
| C) industrial diphenylamine mixture (see above) | 0.42% | 0.48% | 0.48% | 0.48% | 0.42% | 0.42% | 0.29% |
| D) 2,2-Thiodiethyleneglycol-bis-(3,5-di-tert-butyl-4-hydroxycinnamate) | 0.09% | 0.12% | | 0.12% | 0.09% | 0.09% | 0.06% |

TABLE-continued

| | Formulations containing: Example 1 | 2 | 3 | 4 | 5 | 6 | 7 |
|---|---|---|---|---|---|---|---|
| N,N'-Bis-(2,2,6,6-tetramethylpiperidin-4-yl)-hexamethylene-1,6-diamine | | | 0.12% | | | | |
| Pentaerythrityl-tetrakis[3-(3,5-di-tert.-butyl-4-hydroxy-phenyl)-propionate] | 0.09% | | | | 0.09% | 0.09% | 0.09% |

Percentages are given in % by weight, based on the formulation.

EXAMPLE 8

Characterisation of the formulation according to Example 1 under frictional stress The anti-wear action is determined using a commercial oscillatory/frictional wear apparatus (SRV apparatus) by Optimol GmbH, Munich.

The process is described in detail in R. Schumacher, D. Landolt, H. J. Mathieu and H. Zinke, Surface Reaction of Isogeometrical Phosphorus Compounds, ASLE Transaction, 26 (1982), 94–101.

This apparatus is based on the following principle: a steel ball (100 Cr 6), acted upon by a force $F_N$, oscillates on a steel cylinder. The ball is fixed in a holding device and accordingly performs an oscillating sliding movement. The horizontal and vertical force is determined by a piezoelectric force transducer. Under the given test conditions the maximum Hertzian normal stress is 2740 $N/mm^2$ and the maximum shear stress is 850 $N/mm^2$. Ball and cylinder are manufactured from the same tool steel.

A few drops of oil in which the mixture to be tested is dissolved are applied between cylinder and ball. The following test conditions are chosen:

Test conditions:
load: 200N,
temperature: 180° C.,
duration of test: 50 hours,
frequency: 50 Hz,
amplitude: 1000 μm

| Formulation according to Example | Aspect of oil after the test | Duration of test |
|---|---|---|
| oil A 1) only, Comparison | viscous wax | 28.5 hours* |
| 1 | oil | 50 hours |

*Apparatus switches off owing to overloading.

It will be seen that no thickening of the oil occurs with the formulation according to the invention.

In order to characterise the wear, when the test is complete a transverse profile is taken using a stylus instrument (Talysurf by Rank Taylor Hobson, Leicester, England). The integrated transverse profile surface serves as a measure of the wear. The values indicated are a measure of relative wear. The true wear value is calculated by multiplication by the factor $F=2\times10^{-4}$.

EXAMPLES 9 TO 14

Thermal stabilisation of a synthetic oil. The thermal ageing of the formulations is carried out in a pressure differential calorimeter (Pressure Differential Scanning Calorimetry, PDSC).

The process operates in accordance with the following principle: The PDSC cell (thermoanalysis system 1090 by DuPont) consists of a silver heating block. Into this heating block there is inserted a constantan plate which contains the thermoelements (Chromel-Alumel). Sample pans and reference pans are placed onto the thermoelements which are mounted in a slightly raised position. The interior of the DSC cell is coated with a thin film of gold (corrosion protection). The reference pan remains empty, while the sample pan is filled with three drops of the formulation in question. The temperature difference between the sample and reference pans is determined under isothermal conditions. The enthalpy change dH/dt in each case is given in mW. All measurements are made in air containing 400 ppm $NO_x$. The pressure is 8 bar. The basic oil used in each case is Aral RL 136, a commercially available "black sludge reference oil". In order to increase the susceptibility of the oil to oxidation, 1% 1-decene is added to the oil.

During the thermal ageing, the concentration of the additives decreases continuously. At a critical additive concentration the heat flow dQ/dt increases. The time that elapses until this increase takes place is termed the onset time. Accordingly, long onset times indicate that the oils have a high degree of stability towards ageing. The formulations characterised by means of PDSC are shown in Table 2.

TABLE 2

Test conditions: 170° C., 8 bar, air + 400 ppm $NO_x$
Basic oil: A 1) synthetic oil + 8% of the additive package (see above)

| Example | Formulation according to Example | onset time (min.) |
|---|---|---|
| Comparison | oil A 1) only | 50 |
| 9 | 1 | 107 |
| 10 | 2 | 113 |
| 11 | 3 | 130 |
| 12 | 4 | 110 |
| 13 | 5 | 109 |
| 14 | 6 | 110 |

EXAMPLE 15

Thermal stabilisation of a mineral oil. The thermal ageing of the formulation according to Example 7 is determined as described in Examples 9 to 14 using a PDSC cell.

Test conditions: 190° C., 8 bar, air+400 ppm $NO_x$

Basic oil: A 2) mineral oil+8% of the additive package (see above)

TABLE 3

| Formulation according to Example | onset time (min.) |
|---|---|
| oil A 2), Comparison | 28 |
| 7 | 36 |

What is claimed is:

1. A formulation containing

A) a lubricant and a mixture of

B) at least one compound of general formula I

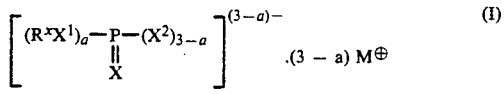

(I)

wherein X, $X^1$ and $X^2$, each independently of the others, are oxygen or sulfur; or $X^2$ is

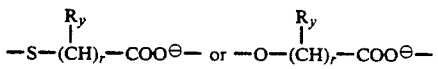

in which r is 1 or 2 and Ry is —H or —$CH_3$; wherein $R^x$ is $C_1$–$C_{24}$alkyl or is $C_2$–$C_{12}$alkyl that is interrupted by —O—, —S— and/or —C(O)O—; unsubstituted or $C_1$–$C_{12}$alkylsubstituted phenyl; $C_5$–$C_{12}$cycloalkyl or $C_5$–$C_{12}$cycloalkyl that is substituted by $C_1$–$C_4$alkyl; or $C_7$–$C_{13}$aralkyl or $C_7$–$C_{13}$aralkyl that is interrupted in the alkyl radical by —O— or —S—; a is 1 or 2, and in the case where a is 2, the radicals $R^x$ are identical or different or two radicals $R^x$ together with the two hetero atoms $X^1$ and the P atom to which they are bonded form a 5- or 6-membered ring by means of a dimethylene or trimethylene group or by means of a dimethylene or trimethylene group that is substituted by at least one $C_1$–$C_4$alkyl group; and wherein M⊕ is an alkali metal cation, with the proviso that when a is 1, two different M⊕ are possible, C) at least one compound of Formula II

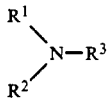

(II)

wherein $R^1$ is $C_1$–$C_{18}$alkyl, $C_7$–$C_9$phenylalkyl, $C_5$–$C_{12}$cycloalkyl, phenyl, $C_7$–$C_{18}$alkylphenyl, $C_7$–$C_{18}$alkoxyphenyl or naphthyl, $R^2$ is phenyl, $C_7$–$C_{18}$alkylphenyl, $C_7$–$C_{18}$alkoxyphenyl or naphthyl, $R^3$ is hydrogen, $C_1$–$C_{12}$alkyl, benzyl, allyl, methallyl, phenyl or a group —$CH_2SR^g$ wherein $R^g$ is —H, alkyl having from 1 to 8 carbon atoms, phenyl or cycloalkyl having from 5 to 12 carbon atoms, and D) at least one phenol of general formula V

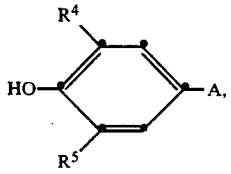

(V)

wherein $R^4$ is H, alkyl having from 1 to 24 carbon atoms, cycloalkyl having from 5 to 12 carbon atoms, $C_1$–$C_4$alkyl-substituted cycloalkyl having from 5 to 12 carbon atoms, phenyl or —$CH_2$—S—$R^{10}$, $R^5$ is alkyl having from 1 to 24 carbon atoms, cycloalkyl having from 5 to 12 carbon atoms, $C_1$–$C_4$alkyl-substituted cycloalkyl having from 5 to 12 carbon atoms, phenyl or —$CH_2$—S—$R^{10}$, and A is —H, alkyl having from 1 to 24 carbon atoms, —$C_qH_{2q}$—N(R')(R''), —$C_qH_{2q}$—$S_z$—Y,

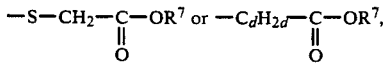

and

Y is —H, alkyl having from 1 to 18 carbon atoms, phenyl, $C_1$–$C_{24}$alkyl-substituted phenyl, benzyl,

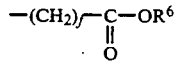

or when q is 0,

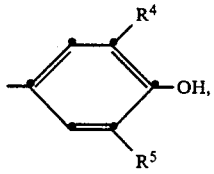

wherein $R^4$ and $R^5$ are each as defined above, R' and R'' are identical or different and are —H or $C_1$–$C_{24}$alkyl, and f is 1 or 2, d is 0, 1, 2 or 3, q is 0, 1, 2 or 3, z is 1, 2, 3 or 4, $R^6$ is $C_1$–$C_{24}$alkyl, $R^7$ is alkyl having from 1 to 24 carbon atoms,

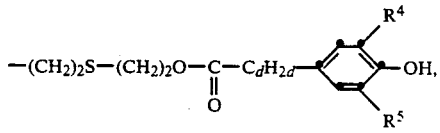

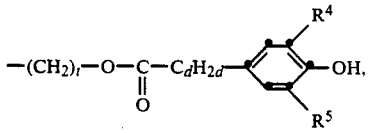

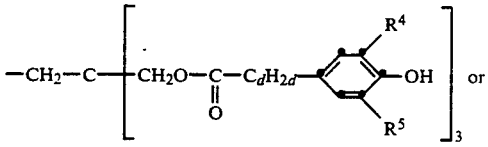

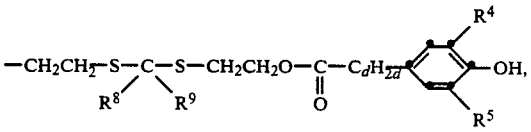

wherein d is in each case 0, 1, 2 or 3 and t is 2, 3, 4, 5 or 6, and wherein $R^4$ and $R^5$ are each as defined above, and $R^8$ and $R^9$, each independently of the other, are H, alkyl having from 1 to 12 carbon atoms, phenyl or phenyl substituted by one or two $C_1$–$C_4$alkyl groups and/or —OH, or $R^8$ and $R^9$ together with the carbon atom linking them form a $C_5$–$C_{12}$cyclo-alkyl group, and $R^{10}$ is $C_1$–$C_{18}$alkyl, phenyl or $$-(CH_2)_f-\underset{\underset{O}{\|}}{C}-OR^6$$

wherein f and $R^6$ are as defined above.

2. A formulation according to claim 1, containing B) at least one compound of general formula I wherein X is sulfur, $X^1$ is oxygen, $X^2$ is sulfur or oxygen, $R^x$ is $C_3$–$C_8$alkyl or $C_8$–$C_{12}$alkyl-substituted phenyl, a is 2, b is 1 and $M^{\oplus}$ is $Na^{\oplus}$ or $K^{\oplus}$.

3. A formulation according to claim 2, containing B) at least one compound of general formula I wherein M is Na.

4. A formulation according to claim 1, containing B) at least one of the compounds O,O-bis-2-ethylhexylsodium dithiophosphate, O,O-bis-2-ethylhexylsodium thionophosphate, O,O-bis-2-methylpropylsodium dithiophosphate, O,O-bis-nonylphenylsodium dithiophosphate or S-[O,O-bis-2-ethylhexylthiophosphoryl]-sodium thioglycolate.

5. A formulation according to claim 1, containing C) at least one compound of formula II wherein $R^1$ is $C_1$–$C_4$alkyl, $C_7$–$C_9$phenylalkyl, cyclohexyl, phenyl, $C_{10}$–$C_{18}$alkylphenyl or naphthyl, $R^2$ is $C_{10}$–$C_{18}$alkylphenyl or phenyl, and $R^3$ is hydrogen, $C_1$–$C_8$alkyl, benzyl, allyl or a group $-CH_2SR^g$ wherein $R^g$ is —H, $C_1$–$C_4$alkyl, phenyl or cyclohexyl.

6. A formulation according to claim 1, containing C) at least one compound from the series of the aromatic amines of formula II wherein $R^1$ and $R^2$, each independently of the other, are phenyl or $C_{10}$–$C_{18}$alkylphenyl and $R^3$ is hydrogen.

7. A formulation according to claim 1, containing as C) 4,4'-di-tert.-octyldiphenylamine.

8. A formulation according to claim 1, containing as C) a mixture of diphenylamine compounds containing

| | |
|---|---|
| 1 to 5% by weight | a) diphenylamine, |
| 8 to 18% by weight | b) 4-tert.-butyldiphenylamine, |
| 21 to 31% by weight | c) one or more of the compounds |
| | i) 4-tert.-octyldiphenylamine, |
| | ii) 4,4'-di-tert.-butyldiphenylamine, |
| | iii) 2,4,4'-tris-tert.-butyldiphenylamine, |
| 20 to 31% by weight | d) one or more of the compounds |
| | i) 4-tert.-butyl-4'-tert.-octyldiphenylamine, |
| | ii) 2,2'-or 2,4'-di-tert.-octyldiphenylamine, |
| | iii) 2,4-di-tert.-butyl-4'-tert.-octyldiphenylamine, and |
| 15 to 29% by weight | e) the compound |
| | i) 4,4'-di-tert.-octyldiphenylamine or the compounds |
| | i) 4,4'-di-tert.-octyldiphenylamine and |
| | ii) 2,4-di-tert.-octyl-4'-tert.-butyldiphenylamine. |

9. A formulation according to claim 1, containing D) at least one compound from the series of the phenols of formula V wherein A is $-C_qH_{2q}-S_z-Y$, q is 0 or 1 and z is 1 or 2 and Y is alkyl having from 4 to 18 carbon atoms, phenyl, $C_2$–$C_8$alkyl-substituted phenyl or $$-CH_2-\underset{\underset{O}{\|}}{C}-OR^6$$

wherein $R^6$ is $C_1$–$C_{18}$alkyl.

10. A formulation according to claim 1, wherein A in the compounds of formula V is

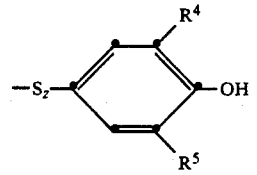

and z is 1 or 2, $R^4$ is H or $C_1$–$C_5$alkyl and $R^5$ is $C_1$–$C_5$alkyl.

11. A formulation according to claim 1, wherein A in the compounds of formula V is $$-C_dH_{2d}-\underset{\underset{O}{\|}}{C}-OR^7$$

wherein d is 2 or 3 and $R^7$ is

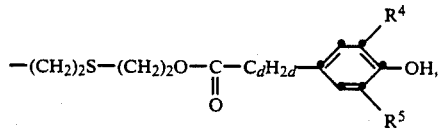

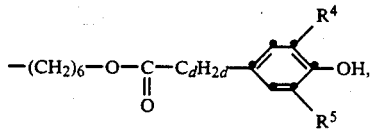

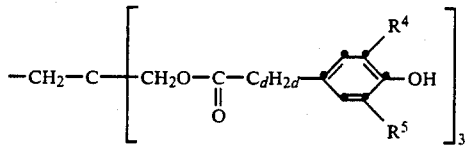

or

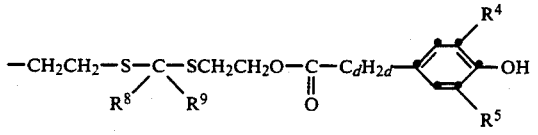

wherein d is in each case 2 or 3, $R^4$ and $R^5$ are as defined in claim 1 and $R^8$ and $R^9$, each independently of the other, are —H, $C_1$–$C_9$alkyl or phenyl or

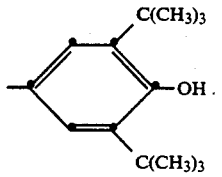

12. A formulation according to claim 1, wherein $R^4$ in formula V is hydrogen or alkyl having from 1 to 4 carbon atoms and $R^5$ is alkyl having from 1 to 4 carbon atoms.

13. A formulation according to claim 1, wherein $R^4$ and $R^5$ in formula V are tert.-butyl.

14. A formulation according to claim 1 that contains as compounds of formula V

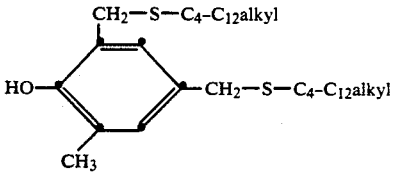

and/or

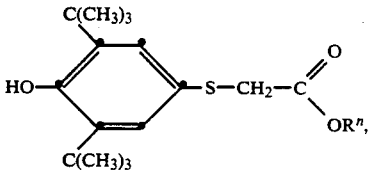

wherein $R^n$ is $C_6$–$C_{18}$alkyl.

15. A formulation according to claim 1 containing as B) O,O-bis-2-ethylhexylsodium dithiophosphate, O,O-bis-2-ethylhexylsodium thionophosphate, O,O-bis-2-methylpropylsodium dithiophosphate, O,O-bis-nonylphenylsodium dithiophosphate or S-[O,O-bis-2-ethylhexylthiophosphoryl]-sodium thioglycolate, as C) a mixture of diphenylamine compounds comprising

| | |
|---|---|
| 1 to 5% by weight | a) diphenylamine, |
| 8 to 18% by weight | b) 4-tert.-butyldiphenylamine, |
| 21 to 31% by weight | c) one or more of the compounds<br>i) 4-tert.-octyldiphenylamine,<br>ii) 4,4'-di-tert.-butyldiphenylamine,<br>iii) 2,4,4'-tris-tert.-butyldiphenylamine, |
| 20 to 31% by weight | d) one or more of the compounds<br>i) 4-tert.-butyl-4'-tert.-octyldiphenylamine,<br>ii) 2,2'-or 2,4'-di-tert.-octyldiphenylamine,<br>iii) 2,4-di-tert.-butyl-4'-tert.-octyl-diphenylamine, and |
| 15 to 29% by weight | e) the compound<br>i) 4,4'-di-tert.-octyldiphenylamine or the compounds<br>i) 4,4'-di-tert.-octyldiphenylamine and<br>ii) 2,4-di-tert.-octyl-4'-tert.-butyl-diphenylamine. |

and as D) one of the compounds 2,2-thiodiethylene-bis-3,5-di-tert.-butyl-4-hydroxyhydrocinnamate or pentaerythrityl-tetrakis-[3-(3,5-di-tert.-butyl-4-hydroxyphenyl)-propionate].

16. A formulation according to claim 1, containing A) a lubricant and from 0.01 to 10% by weight, based on the formulation, of a mixture of B), C) and D).

17. A formulation according to claim 16, wherein the mixture of B), C) and D) contains from 20 to 88% by weight B), from 10 to 60% by weight C) and from 2 to 20% by weight D).

18. A formulation according to claim 17, wherein the ratio by weight of compounds of series C) to compounds of series D) is 3–5:1.

19. A formulation according to claim 1, wherein component (C) is a compound of formula II and component (D) is a phenol of formula V.

* * * * *